US010253949B2

(12) United States Patent
Itoh et al.

(10) Patent No.: US 10,253,949 B2
(45) Date of Patent: Apr. 9, 2019

(54) LIGHTING DEVICE, LIGHTING REFLECTOR AND PRODUCTION METHOD THEREFOR

(71) Applicant: SHARP KABUSHIKI KAISHA, Osaka-shi, Osaka (JP)

(72) Inventors: Shin Itoh, Osaka (JP); Masahiro Konishi, Osaka (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 419 days.

(21) Appl. No.: 14/904,804

(22) PCT Filed: Jul. 9, 2014

(86) PCT No.: PCT/JP2014/068252

§ 371 (c)(1),
(2) Date: Jan. 13, 2016

(87) PCT Pub. No.: WO2015/016024

PCT Pub. Date: Feb. 5, 2015

(65) Prior Publication Data

US 2016/0178162 A1 Jun. 23, 2016

(30) Foreign Application Priority Data

Jul. 30, 2013 (JP) ..... 2013-158136

(51) Int. Cl.
*F21V 7/22* (2018.01)
*C25D 11/04* (2006.01)
(Continued)

(52) U.S. Cl.
CPC ..... *F21V 7/22* (2013.01); *C25D 11/04* (2013.01); *C25D 11/16* (2013.01); *F21V 7/06* (2013.01);
(Continued)

(58) Field of Classification Search
CPC ..... F21Y 2115/10; F21V 7/22; F21V 7/06; F21V 7/28; C05D 11/04; C05D 11/16
(Continued)

(56) References Cited

U.S. PATENT DOCUMENTS

2012/0069547 A1* 3/2012 Gielen ..... F21K 9/54 362/84
2015/0131295 A1* 5/2015 Mayer ..... G02B 5/0825 362/296.03
(Continued)

FOREIGN PATENT DOCUMENTS

JP 2001-264747 9/2001
JP 2005-190859 7/2005
(Continued)

OTHER PUBLICATIONS

English translation of JP 2013-062127 A; J-Plat Pat; Jul. 7, 2018; 15 pages.*
(Continued)

*Primary Examiner* — Laura Tso
(74) *Attorney, Agent, or Firm* — ScienBiziP, P.C.

(57) ABSTRACT

A lighting reflector 10 includes a base member 11, made of metal, having an inner circumferential surface 13*a* expanding toward a light exit aperture 14 open at an end in an axial direction. A thin-film layer 17 which is formed from a thin film containing ceramic and which scatters light is placed on an end portion of the inner circumferential surface 13*a* that is on the opposite side to the light exit aperture 14.

14 Claims, 13 Drawing Sheets

(51) Int. Cl.

| | |
|---|---|
| ***C25D 11/16*** | (2006.01) |
| ***F21V 7/06*** | (2006.01) |
| *F21Y 105/10* | (2016.01) |
| *F21Y 115/10* | (2016.01) |

(52) U.S. Cl.
CPC ..... *F21Y 2105/10* (2016.08); *F21Y 2115/10* (2016.08)

(58) Field of Classification Search
USPC .... 362/296.03, 296.08, 296.04, 296.02, 341, 362/343
See application file for complete search history.

(56) References Cited

U.S. PATENT DOCUMENTS

2015/0354782 A1* 12/2015 Konishi ..... F21V 7/22 362/277
2016/0033110 A1* 2/2016 Cai ..... F21K 9/233 362/296.02

FOREIGN PATENT DOCUMENTS

| | | |
|---|---|---|
| JP | 2010-008600 | 1/2010 |
| JP | 2010-140674 | 6/2010 |
| JP | 2012-234650 | 11/2012 |
| JP | 2013-062127 | 4/2013 |
| JP | 2013-143234 | 7/2013 |

OTHER PUBLICATIONS

International Search Report for PCT/JP2014/068252 dated Sep. 2, 2014, two pages.

* cited by examiner

LIGHTING DEVICE, LIGHTING REFLECTOR AND PRODUCTION METHOD THEREFOR

This application is the U.S. national phase of International Application No. PCT/JP2014/068252 filed 9 Jul. 2014 which designated the U.S. and claims priority to JP Patent Application No. 2013-158136 filed 30 Jul. 2013, the entire contents of each of which are hereby incorporated by reference.

TECHNICAL FIELD

The present invention relates to a lighting reflector reflecting light emitted from a light source and a production method therefor. The present invention also relates to a lighting device including a light source and a lighting reflector reflecting light emitted from the light source.

BACKGROUND ART

Conventional lighting devices are disclosed in Patent Literatures 1 to 3. The lighting devices each include a light source composed of an LED and a lighting reflector (hereinafter referred to as the "reflector") reflecting light emitted from the light source. The reflector is composed of a rotating body rotating about an axis aligned with the optical axis of the light source and has a light exit aperture open at an end in an axial direction and an opening which is open at another end and which faces the light source. An inner circumferential surface of the reflector expands toward the light exit aperture.

Light radially emitted from the light source reflects on the inner circumferential surface of the reflector and is focused into parallel light or the like, which is emitted from the light exit aperture.

CITATION LIST

Patent Literature

PTL 1: Japanese Unexamined Patent Application Publication No. 2010-140674 (pages 5 to 11, FIG. 1)

PTL 2: Japanese Unexamined Patent Application Publication No. 2005-190859 (pages 4 to 9, FIG. 3)

PTL 3: Japanese Unexamined Patent Application Publication No. 2012-234650 (pages 4 to 13, FIG. 5)

SUMMARY OF INVENTION

Technical Problem

In recent years, LEDs and the like used as light sources have been souped-up and therefore have been capable of being used in lighting devices for spot lighting or the like. In this field, there is a problem in that a ring-shaped region (yellow ring) with a strong yellow component is formed so as to surround an optical axis and is viewed as the color unevenness of illumination light. In particular, when an LED element includes a light source sealed with a sealing resin containing a phosphor, a yellow ring appears significantly.

It is an object of the present invention to provide a lighting reflector capable of reducing color unevenness and a lighting device including the lighting reflector. Furthermore, it is an object of the present invention to provide a production method for a lighting reflector capable of reducing color unevenness.

Solution to Problem

In order to achieve the above objects, the present invention provides a lighting reflector including a base member, made of metal, having an inner circumferential surface expanding toward a light exit aperture open at an end in an axial direction. A thin-film layer which is formed from a thin film containing ceramic and which scatters light is placed on an end portion of the inner circumferential surface that is on the opposite side to the light exit aperture.

According to the present invention, in the lighting reflector, a non-formation portion of the thin-film layer is placed on an end portion of the inner circumferential surface that is on the light exit aperture side.

According to the present invention, in the lighting reflector, the inner circumferential surface is formed into a paraboloid, the thin-film layer is formed in a ring-shaped region with an angle of 60° to 90° with respect to an axial direction from the focus of the paraboloid toward the light exit aperture, and the non-formation portion of the thin-film layer extends from the ring-shaped region to the light exit aperture.

According to the present invention, in the lighting reflector, the base member is cylinder-shaped and has an opening in an end portion that is on the opposite side to the light exit aperture.

According to the present invention, in the lighting reflector, the base member is cylinder-shaped and has an opening in an end portion that is on the opposite side to the light exit aperture, the thin-film layer is formed in a ring-shaped region with an angle of 60° to 90° with respect to an axial direction from the center of the opening toward the light exit aperture, and the non-formation portion of the thin-film layer extends from the ring-shaped region to the light exit aperture.

According to the present invention, in the lighting reflector, the thin-film layer is placed around the opening.

According to the present invention, in the lighting reflector, the area occupancy of the thin-film layer inside the ring-shaped region is greater than that of the thin-film layer outside the ring-shaped region.

According to the present invention, in the lighting reflector, the thickness of the thin-film layer outside the ring-shaped region is less than that of the thin-film layer inside the ring-shaped region.

According to the present invention, in the lighting reflector, the thin-film layer mainly contains ceramic and glass.

According to the present invention, in the lighting reflector, the base member is made of an aluminium-based material.

According to the present invention, in the lighting reflector, a protective layer made of an insulator for light-transmissive members or high-reflectivity members is placed so as to cover the inner circumferential surface except the thin-film layer.

According to the present invention, in the lighting reflector, a protective layer is placed so as to cover the inner circumferential surface except the thin-film layer, the base member is made of an aluminium-based material, and the protective layer is composed of an anodized film of the base member.

A lighting device according to the present invention includes the lighting reflector configured as described above and a light source placed on an end portion which is on an axis of the lighting reflector and which is on the opposite side to the light exit aperture.

A lighting device according to the present invention includes the lighting reflector configured as described above and a light source placed near the focus.

A lighting device according to the present invention includes the lighting reflector configured as described above and a light source placed near the center of the opening.

According to the present invention, in the lighting device, the light source includes a light-emitting element emitting light with a predetermined wavelength and a phosphor that excites and converts light emitted from the light-emitting elements into light with a wavelength different from the predetermined wavelength.

According to the present invention, in the lighting device, the light source has an input power of more than 10 W.

The present invention provides a production method for a lighting reflector including a base member, made of metal, having an inner circumferential surface expanding toward a light exit aperture open at an end in an axial direction. The method includes a thin-film layer-forming step of forming a thin-film layer which scatters light and which mainly contains glass and ceramic on an end portion of the inner circumferential surface that is on the opposite side to the light exit aperture. In the thin-film layer-forming step, the thin-film layer is formed in such a manner that a paint containing particles of ceramic and glass raw materials is applied to the inner circumferential surface and glass is synthesized from the glass raw materials by a sol-gel method.

The present invention provides a production method for a lighting reflector including a base member, made of metal, having an inner circumferential surface expanding toward a light exit aperture open at an end in an axial direction. The method includes a thin-film layer-forming step of forming a thin-film layer consisting of a thin film and scattering light on an end portion of the inner circumferential surface that is on the opposite side to the light exit aperture. In the thin-film layer-forming step, a thermosetting resin containing particles of ceramic is applied to the inner circumferential surface and is then cured.

According to the present invention, the production method for the lighting reflector further includes a protective layer-forming step of forming a protective layer covering a non-formation region of the thin-film layer on the inner circumferential surface. The base member mainly contains aluminium and in the protective layer-forming step, the protective layer is formed by anodizing the base member so as to be composed of an anodized film.

According to the present invention, in the production method for the lighting reflector, the protective layer-forming step is performed after the thin-film layer-forming step.

Advantageous Effects of Invention

In accordance with a lighting reflector according to the present invention, a thin-film layer which contains ceramic and which scatters light is placed on an end portion of an inner circumferential surface of a base member made of metal, the end portion being on the opposite side to a light exit aperture. This enables the occurrence of a yellow ring of illumination light emitted from the light exit aperture to be suppressed, thereby enabling the color unevenness of illumination light to be reduced.

In accordance with a production method for a lighting reflector according to the present invention, a thin-film layer is formed in such a manner that a paint containing particles of ceramic and glass raw materials is applied to an inner circumferential surface of a base member and glass is synthesized from the glass raw materials by a sol-gel method. This enables the thin-film layer to be readily formed at low temperature such that the thin-film layer contains ceramic, thereby enabling the accuracy deterioration of the lighting reflector to be prevented.

In accordance with a production method for a lighting reflector according to the present invention, a thin-film layer is formed in such a manner that a thermosetting resin containing particles of ceramic is applied to an inner circumferential surface of a base member and is then cured. This enables the thin-film layer to be readily formed at low temperature such that the thin-film layer contains ceramic, thereby enabling the accuracy deterioration of the lighting reflector to be prevented and enabling costs to be reduced.

DESCRIPTION OF EMBODIMENTS

First Embodiment

Figure 1:
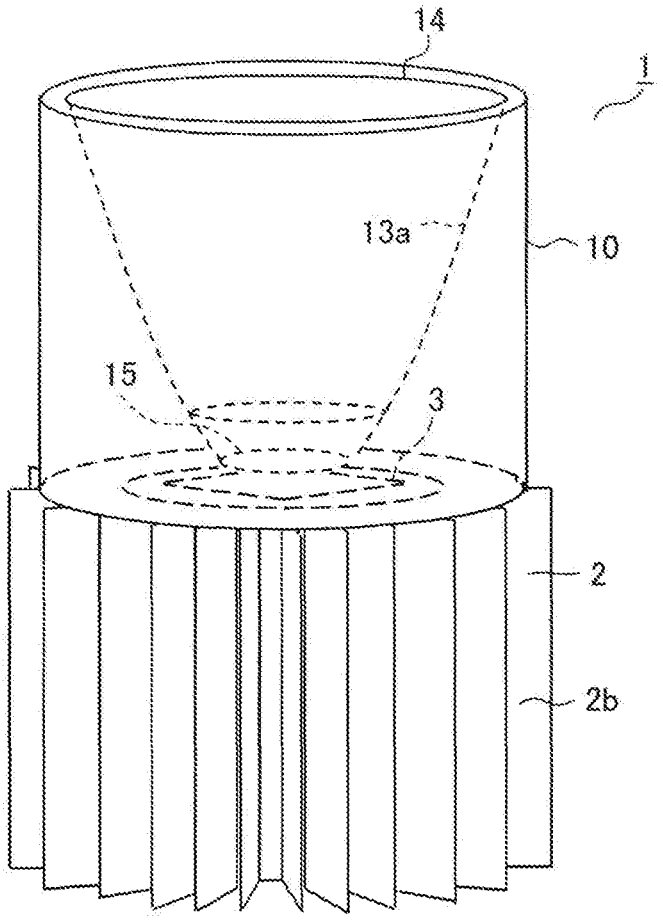
FIG. 1 is a perspective view of a lighting device according to a first embodiment of the present invention.
Figure 2:
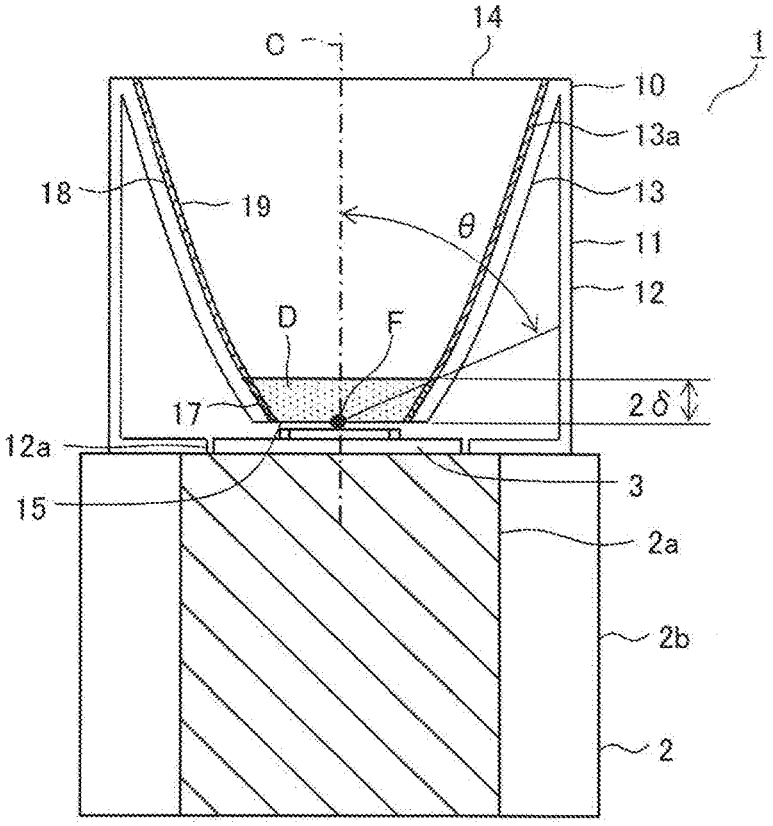
FIG. 2 is a front sectional view of the lighting device according to the first embodiment of the present invention.

Embodiments of the present invention are described below with reference to the drawings. FIG. 1 and FIG. 2 are a perspective view and front sectional view, respectively, of a lighting device according to a first embodiment of the present invention. The lighting device 1 includes a light source 3 and reflector 10 placed on a heat sink 2.

The reflector 10 includes a base member 11 made of metal such as aluminium. The base member 11 includes an outer frame section 12 attached to the heat sink 2 and a light-reflecting section 13 placed inside the outer frame section 12. The bottom of the outer frame section 12 has an insertion hole 12*a* where the light source 3 is inserted. The light-reflecting section 13 is cylinder-shaped and has a light exit aperture 14 open at one end in a direction of a symmetry axis (axis C) and an opening 15 at the other end. The light source 3 is placed on the axis C so as to face the opening 15. Light emitted from the light source 3 reflects on the inner surface of the reflector 10 and illumination light is emitted from the light exit aperture 14.

Figure 3:
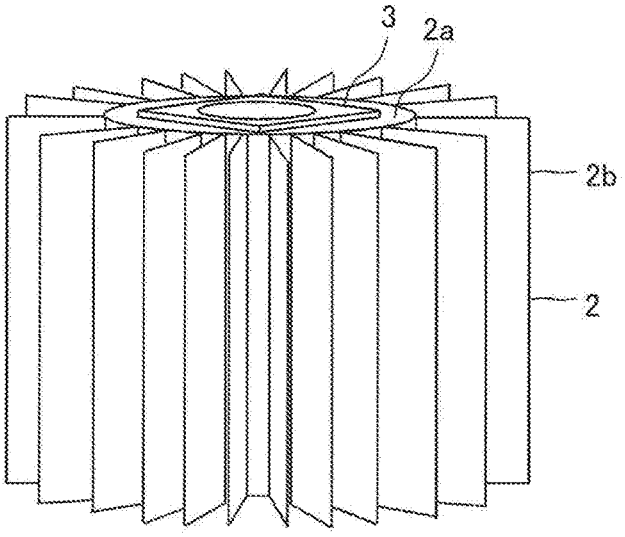
FIG. 3 is a perspective view of a heat sink of the lighting device according to the first embodiment of the present invention.

FIG. 3 is a perspective view of the heat sink 2, which is provided with the light source 3. The heat sink 2 is made of metal such as aluminium and includes a columnar pillar section 2*a* and a plurality of heat-dissipating fins 2*b* radially protruding from a peripheral surface of the pillar section 2*a*. The light source 3 is placed on an end surface of the pillar section 2*a*.

Figure 4:
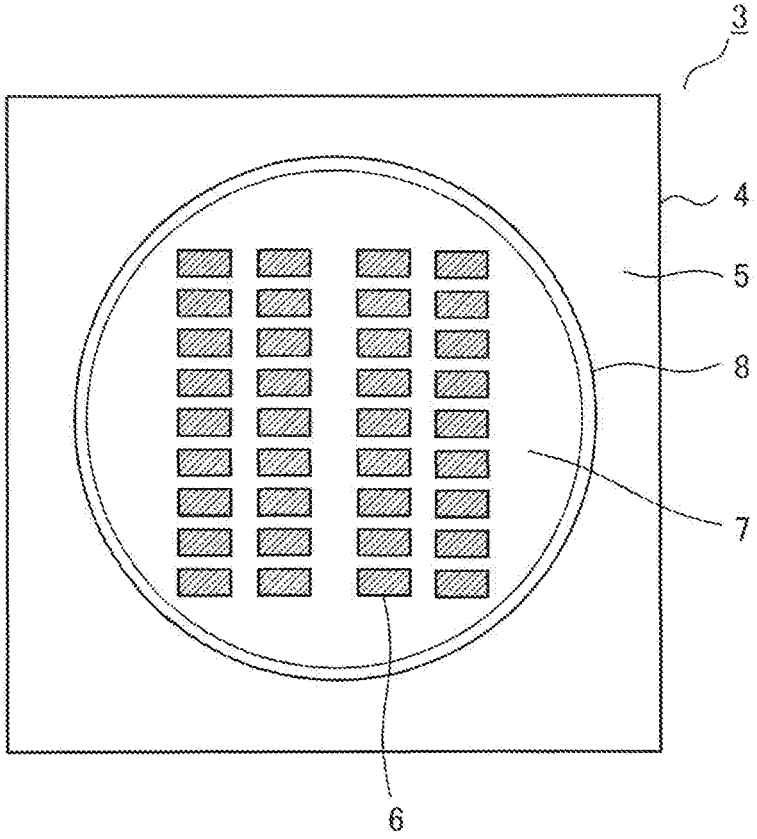
FIG. 4 is a plan view of a light source of the lighting device according to the first embodiment of the present invention.
Figure 5:
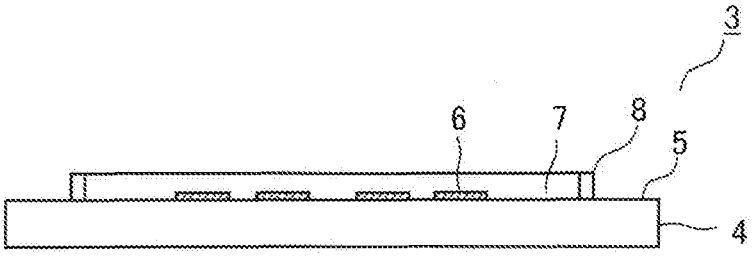
FIG. 5 is a front sectional view of the light source of the lighting device according to the first embodiment of the present invention.

FIG. 4 and FIG. 5 are a plan view and front sectional view, respectively, of the light source 3. The light source 3 is composed of a COB (chip on board) type of light-emitting module 4 including a ceramic substrate 5 and a plurality of light-emitting elements 6, such as LED elements, EL elements or the like, mounted on the substrate 5.

A frame 8 is placed on the substrate 5 so as to surround the light-emitting elements 6. A sealing resin 7 is filled in the frame 8, whereby the light-emitting elements 6 are sealed. The sealing resin 7 contains a phosphor that excites and converts light emitted from the light-emitting elements 6 into light with a different wavelength. This allows the light source 3 to induce surface emission on the surface of the sealing resin 7.

The light source 3 is a high output (an input power of 10 W, 50 W, 100 W or more) depending on the integration of the light-emitting elements and is configured such that high-intensity light is emitted. Therefore, the light source 3 generates a large amount of heat; hence, high heat dissipation properties are ensured by the heat sink 2 (see FIG. 3) because the heat sink 2 has a very large volume as compared to the light source 3.

Blue LEDs, violet LEDs, ultraviolet LEDs, and/or the like can be used as the light-emitting elements 6. As the phosphor, a blue, green, yellow, orange, or red one or a combination of arbitrary phosphors can be used. This allows the light source 3 to emit light of a desired color. The phosphor may be omitted from the sealing resin 7. Three-color (blue, green, and red) light-emitting elements 6 having different emission wavelengths may be arranged on the substrate 5 without using the phosphor in the sealing resin 7.

Figure 6:
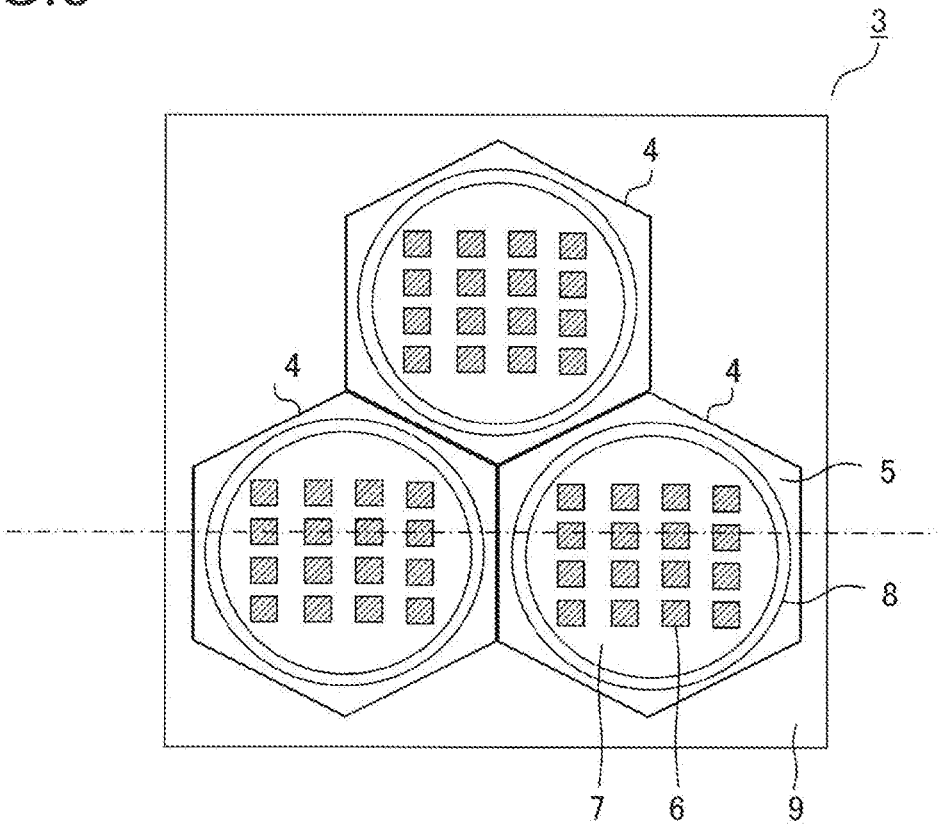
FIG. 6 is a plan view of another light source of the lighting device according to the first embodiment of the present invention.
Figure 7:
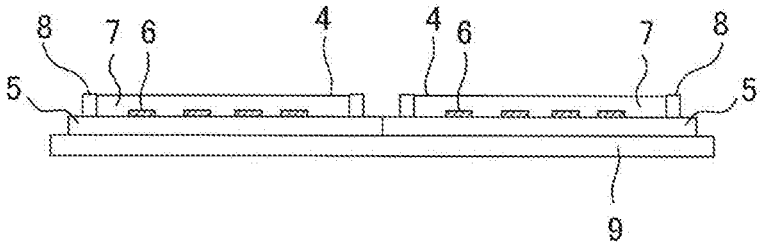
FIG. 7 is a front sectional view of another light source of the lighting device according to the first embodiment of the present invention.

The light source 3 is not limited to the above configuration. FIG. 6 and FIG. 7 are a plan view and front sectional view, respectively, of a light source 3 having another configuration. This light source 3 is configured such that a plurality of light-emitting modules 4 are laid on a base 9. These light-emitting modules 4 are evenly arranged around the axis C (see FIG. 2). The center of gravity of this light source 3 is placed on the axis C.

Figure 8:
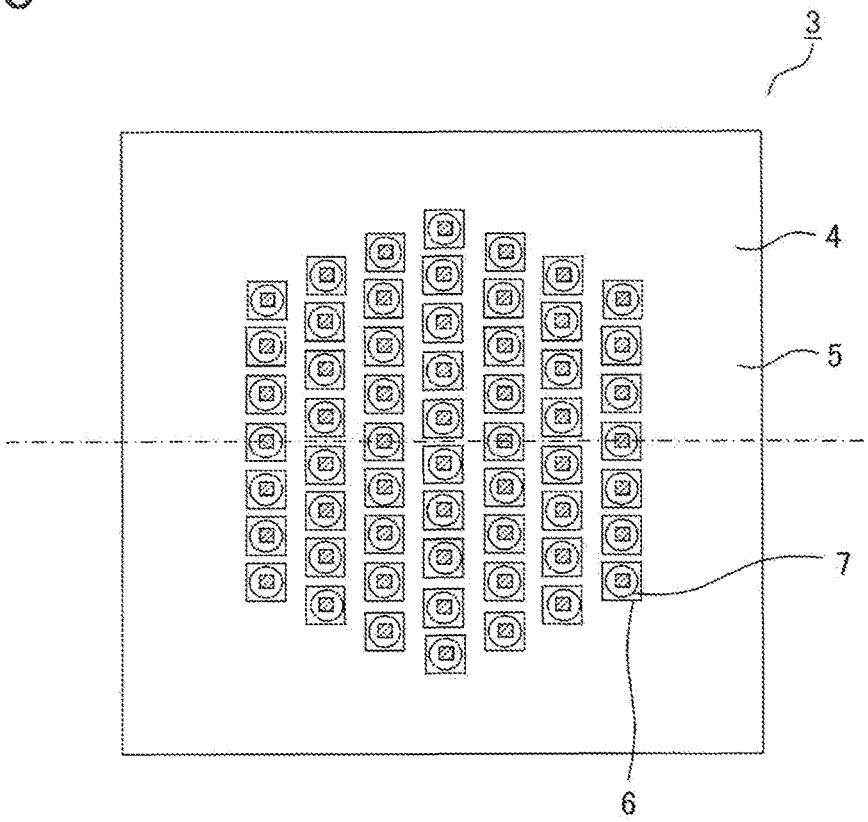
FIG. 8 is a plan view of another light source of the lighting device according to the first embodiment of the present invention.
Figure 9:
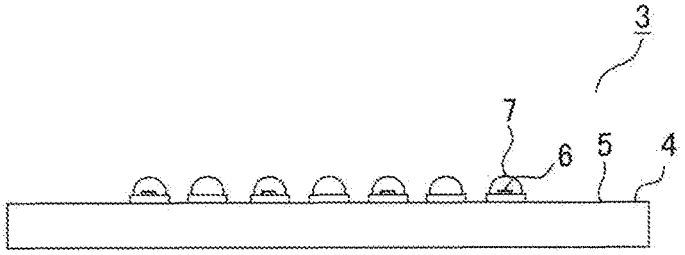
FIG. 9 is a front sectional view of another light source of the lighting device according to the first embodiment of the present invention.

FIG. 8 and FIG. 9 are a plan view and front sectional view, respectively, of a light source 3 having another configuration. This light source 3 is composed of a light-emitting module 4 including light-emitting elements 6 which are mounted on a substrate 5 and which are covered with a hemispheric sealing resin 7. This light source 3 may be configured by arranging a plurality of these light-emitting modules 4.

Referring back to FIG. 2, an inner circumferential surface 13*a* of the light-reflecting section 13, which is formed of the base member 11 made of metal, is formed of a paraboloid obtained by rotating a parabola about the axis C. Therefore, the inner circumferential surface 13*a* expands toward the light exit aperture 14 in a direction of the axis C. The inner peripheral surface 13*a* is mirror-finished and has high reflectivity.

A thin-film layer 17 is placed on a predetermined region of the inner circumferential surface 13*a* as described below in detail. A protective layer 19 made of an insulator is placed on a non-formation portion 18, in which the thin-film layer 17 is not formed, on the inner circumferential surface 13*a*.

The thin-film layer 17 is formed from a thin film containing ceramic and roughens the inner circumferential surface 13*a* to scatter light. This enables the color unevenness of illumination light emitted from the light exit aperture 14 to be reduced. Since ceramic has high electrostatic strength, the thin-film layer 17 is preferably formed around the opening 15 (the lower surface of the light-reflecting section 13). This enables shorting between the light source 3, which is close to the opening 15, and the reflector 10 to be prevented.

When the thickness of the thin-film layer 17 is, for example, about 10 μm, the thin-film layer 17 has the effect of reducing color unevenness. In order to enhance the effect of reducing color unevenness and in consideration of the mechanical strength of the thin-film layer 17, the thickness of the thin-film layer 17 is preferably about 50 μm to 500 μm. When the thickness of the thin-film layer 17 is more than 1 mm, the thin-film layer 17 is likely to be cracked. Therefore, the thickness thereof is preferably 1 mm or less.

The thin-film layer 17 is formed in a thin-film layer-forming step. The thin-film layer 17 can be formed in such a manner that, for example, a ceramic raw material is applied to the base member 11 and is then calcined at high temperature. Since the calcination temperature of ceramic is 1,200° C. to 1,400° C. in this operation, the base member 11 needs to be made of a refractory metal.

Therefore, in the thin-film layer-forming step, the thin-film layer 17 may be formed in such a manner that a ceramic paint containing particles of ceramic calcined at high temperature and a binder made of glass is applied to the base member 11 and is then calcined. This allows the calcination temperature of glass to be about 900° C.; hence, the base member 11, which has a low melting point, can be used. Since a glass component, as well as ceramic, has high electrostatic strength, the thin-film layer 17 can be formed without reducing insulating properties.

The binder made of glass is one obtained by combining particles of low-melting point glass with an organic binder. When the low-melting point glass is re-melted, the organic binder is evaporated due to high temperature and only a glassy layer containing ceramic particles remains. The low-melting point glass particles, which have a low melting point, need to be heated to a calcination temperature of 800° C. to 900° C. in order to re-melt the low-melting point glass particles. This calcination temperature exceeds 660° C., which is the melting point of aluminium. Therefore, the base member 11 may be made of an aluminium alloy material, prepared by adding an appropriate impurity to aluminium, having an increased melting point.

In the thin-film layer-forming step, the binder made of glass is preferably prepared by a sol-gel method. That is, the thin-film layer 17 is formed in such a manner that after a ceramic paint containing the ceramic particles calcined at high temperature and glass raw materials is applied to the base member 11, glass is synthesized from the glass raw materials by the sol-gel method.

This enables the binder made of glass to be prepared at 200° C. to 500° C. and therefore the base member 11, which has a low melting point, can be used. Thus, material options for the base member 11 can be expanded and the damage (for example, accuracy deterioration, oxidation, or the like) of the base member 11 due to heat can be reduced.

Since the melting point of aluminium is about 660° C., the thin-film layer 17 can be formed on the base member 11, which is made of an aluminium-based material mainly containing aluminium, by the sol-gel method in the above step. The aluminium-based material is inexpensive, is easy to process, is lightweight, and can be used to obtain high reflectivity and high heat dissipation. Thus, it is preferred that the aluminium-based material is used as the base member 11 and the thin-film layer 17 is formed by the sol-gel method in the above step.

The thickness of the thin-film layer 17, which contains the binder made of glass and ceramic, can be reduced to the diameter of particles of ceramic. If the size of the ceramic particles is adjusted to, for example, 10 μm or less, the thin-film layer 17 can be thinned to 10 μm. When the thin-film layer 17 contains a sufficient amount of the ceramic particles, light can be scattered on the thin-film layer 17 even if the thin-film layer 17 is thin.

The glass component, which is used as a binder, has heat resistance, light resistance, and electrostatic strength as is the case with ceramic and therefore is preferred as a reflective material for lighting devices. In particular, when the light source 3 has an input power of 10 W to 100 W or an input power of more than 100 W, the heat generation and light emission of the light source 3 cause severe conditions. Therefore, a stable material like glass is preferred.

For example, zirconia or the like with high light reflectivity is used as ceramic particles contained in the ceramic paint. Furthermore, silica may be mixed with some of the ceramic particles so as to act as a reinforcing agent for the thin-film layer 17, which is formed by calcining the ceramic paint.

The following materials can be used as ceramic particles with high light reflectivity: typical white inorganic materials, such as titanium oxide, alumina, magnesium oxide, zinc oxide, barium sulfate, zinc sulfate, magnesium carbonate, calcium carbonate, and wollastonite, other than zirconia. Aluminium nitride particles and the like may be used as ceramic materials with high thermal conductivity. Other ceramic materials with high reflectivity or thermal conductivity may be used. Particles of these ceramic materials may be appropriately selected and may be used in combination.

These ceramic materials are not limited to metal oxides and may be insulating materials reflecting light emitted from a light-emitting element. These ceramic materials include, for example, ceramics in a broad sense including aluminium nitride or the like, that is, general solid inorganic materials. Among these solid inorganic materials, an arbitrary material which is excellent in heat resistance, light resistance, light reflectivity, and light scattering can be used.

However, it is not appropriate to use a ceramic material absorbing light. For example, silicon nitride, silicon carbide, and the like are generally black and are inadequate as a material for the thin-film layer 17, which reflects light.

The thin-film layer-forming step, in which the sol-gel method is used, is further described in detail. In the thin-film layer-forming step, first, the ceramic paint containing the ceramic particles is applied to a predetermined portion of the inner circumferential surface 13*a* of the light-reflecting section 13, which is formed of the base member 11 made of metal, by spray painting or the like. Next, the thin-film layer 17 is formed by synthesizing glass by the sol-gel method.

The calcination temperature of the binder made of glass used in the sol-gel method is usually 200° C. to 500° C. It is effective that the calcination temperature thereof is 400° C. to 500° C. This enables the number of pores in a porous film produced in the form of glassy gel to be reduced, thereby enhancing insulating properties of the thin-film layer 17.

Therefore, it is preferred that the ceramic paint is applied to the inner circumferential surface 13*a* by spray painting using sol for synthesizing glass by the sol-gel method as a binder for zirconium particles and the binder is dried at 200° C. to 300° C. and is then calcined at 400° C. to 500° C. This enables the thin-film layer 17, which has high insulating properties, to be readily formed.

In the thin-film layer-forming step, the thin-film layer 17 may be formed in such a manner that a thermosetting resin containing the ceramic particles is applied to the base member 11, is dried, and is then cured. In order to prevent the thermosetting resin from being deteriorated with time or discolored due to the heat generated from the light source 3 or the irradiation of intense light such as blue light, the thermosetting resin used is one that has high heat resistance and high light resistance. An epoxy resin, a silicone resin, a polyimide resin, a fluorinated resin, or the like can be used as a thermosetting resin which is excellent in heat resistance and light resistance and which is highly transparent.

Although the thin-film layer 17 fixed on the base member 11 with the thermosetting resin is lower in long-term reliability as compared to the thin-film layer 17 fixed on the base member 11 with the binder made of glass, the thin-film layer 17 can be readily formed at low temperature. For example, the curing temperature of most of silicone resins is low, about 200° C. This enables the base member 11 to be prevented from being damaged by heat in manufacturing steps and also enables the cost of the reflector 10 to be reduced. Therefore, the reflector 10, which includes the thin-film layer 17 fixed with the thermosetting resin, can be used depending on purposes or applications.

In the thin-film layer-forming step, the thin-film layer 17 may be formed by another method. The thin-film layer 17 can be formed by, for example, thermal spraying, an AD method (aerosol deposition method), or the like. Thermal spraying and the AD method are used to form the thin-film layer 17 by ejecting the ceramic particles toward the base member 11 at high speed. Though there are a method for accelerating particles and various derived methods distinguished depending on the difference in size or temperature of particles used in addition to thermal spraying and the AD method, these methods are common in that the thin-film layer 17 is formed by ejecting the ceramic particles at high speed.

In order to increase the adhesion between the base member 11 and the thin-film layer 17, after a surface of the base member 11 is roughened by sandblasting as pretreatment, the ceramic particles may be ejected.

Furthermore, a buffer layer may be placed between the base member 11 and the thin-film layer 17 such that the delamination of the thin-film layer 17 due to thermal expansion or thermal contraction is prevented. A material with a linear expansion coefficient less than that of the base member 11 may be used as the buffer layer. More preferably, a material that is less in linear expansion coefficient than the base member 11 and that is greater in linear expansion coefficient than the thin-film layer 17 may be used as the buffer layer.

In particular, in the case where aluminium is used for the base member 11 and alumina is used for the thin-film layer 17, a NiAl alloy is preferably used as the buffer layer. When the weight percentage of Ni in the NiAl alloy is 90% or more, the buffer layer can be formed so as to have a linear expansion coefficient between that of aluminium and that of alumina. This enables the delamination of the thin-film layer 17 made of alumina to be prevented even if the base member 11 made of aluminium is expanded and contracted due to thermal history, because this influence is reduced by the buffer layer.

The buffer layer is not limited to metal materials including alloys and may be made of another material (for example, resin). That is, in consideration of the linear expansion coefficient of materials actually used for the base member 11 and the thin-film layer 17, a material with an appropriate linear expansion coefficient may be selected for the buffer layer as described above. The buffer layer is more preferably made of a material excellent in heat resistance and heat dissipation.

The protective layer 19 is placed in order to prevent a reduction in reflectivity or light-collecting performance due to the oxidation of the inner circumferential surface 13*a* of the base member 11 and in order to ensure electrostatic strength. Therefore, the protective layer 19 is formed using an insulator, having low gas permeability, for light-transmissive members or high-reflectivity members.

The protective layer 19 is formed in a protective layer-forming step. The protective layer 19 can be formed in such a manner that, for example, a paint containing a glass component is applied to the base member 11 and is then calcined such that the protective layer 19 is made of glass. Alternatively, in the protective layer-forming step, the protective layer 19 may be formed in such a manner that a transparent resin having low gas permeability, high light resistance and high heat resistance is applied thereto and is then cured.

When the base member 11 is made of the aluminium-based material, the protective layer 19 may be formed by anodizing the base member 11 in the protective layer-forming step so as to be composed of an anodized film. This enables the protective layer 19 to be formed such that the protective layer 19 is composed of the anodized film of aluminium, which is very hard, is excellent in durability.

Herein, the protective layer-forming step is preferably performed after the thin-film layer-forming step. In this manner, the thin-film layer 17 serves as a protective film during anodizing in the protective layer-forming step. This allows only the non-formation portion 18, which excludes the thin-film layer 17 on the inner circumferential surface 13*a* and where the aluminium-based material is exposed, to be covered with the protective layer 19, which is composed of the anodized film.

In the case where the thin-film layer-forming step is performed after the protective layer-forming step, the base member 11 needs to be partly anodized in the protective layer-forming step. Alternatively, after the whole of the base member 11 is anodized in the protective layer-forming step, the anodized film needs to be removed from a region for forming the thin-film layer 17. This increases man-hours needed for the protective layer-forming step. Therefore, the protective layer-forming step is performed after the thin-film layer-forming step, thereby enabling man-hours needed to manufacture the reflector 10 to be reduced.

Figure 10:
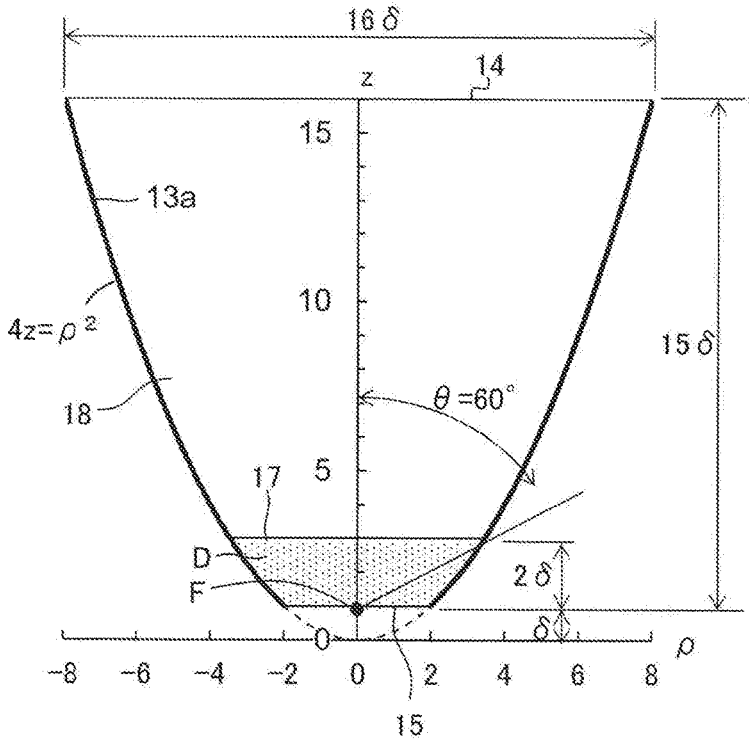
FIG. 10 is a front sectional view illustrating the shape of an inner surface of a reflector of the lighting device according to the first embodiment of the present invention.

The region for forming the thin-film layer 17 is described below. FIG. 10 is a front sectional view illustrating the shape of the inner circumferential surface 13*a* of the light-reflecting section 13. The inner circumferential surface 13*a* is formed of the paraboloid obtained by rotating the parabola as described above. The general formula of the paraboloid is expressed as formula (1), where the focal position is represented by (0, δ). In formula (2), variables z' and ρ' are normalized with δ and are replaced with $z=z'/\delta$ and $\rho=\rho'/\delta$, respectively, for convenience. Herein, a z'-axis and a z-axis are the symmetry axis of the paraboloid aligned with the axis C (see FIG. 2) and a ρ'-axis and a ρ-axis are radial axes.

$$4\delta z'=\rho'^2 \tag{1}$$

$$4z=\rho^2 \tag{2}$$

FIG. 10 shows coordinates of the inner circumferential surface 13*a* on the basis of formula (2). In FIG. 10, the vertex of the paraboloid is placed at the origin. Herein, the distance between the vertex of the paraboloid and a focus F is δ. The opening 15 of the reflector 10 (see FIG. 2) is placed on the focus F. A light-emitting surface of the light source 3 (see FIG. 2) is placed near the focus F.

The thin-film layer 17 is formed on an end portion on the opposite side (opening 15 side) to the light exit aperture 14. In particular, the thin-film layer 17 is formed over the inside of a ring-shaped region D with an angle θ of 60° to 90° with respect to an axial direction from the focus F of the paraboloid toward the light exit aperture 14. The axial length of the thin-film layer 17 is 2δ.

The whole of the inner circumferential surface 13*a* on the light exit aperture 14 side with respect to the thin-film layer 17 is the non-formation portion 18 in which the thin-film layer 17 is not formed. This allows the non-formation portion 18 to be placed on an end portion of the inner circumferential surface 13*a* that is on the light exit aperture 14 side. Herein, the area occupancy of the thin-film layer 17 outside the ring-shaped region D is 0% and the area occupancy of the thin-film layer 17 inside the ring-shaped region D is 100%.

Light-collecting performance can be enhanced in such a manner that the axial length of the light-reflecting section 13 is made sufficiently large with respect to the thin-film layer 17. Therefore, the axial length of the light-reflecting section 13 is preferably 4δ or more and more preferably 8δ or more. In this embodiment, the axial length of the light-reflecting section 13 is 15δ and the diameter of the light exit aperture 14 is 16δ.

Figure 11:
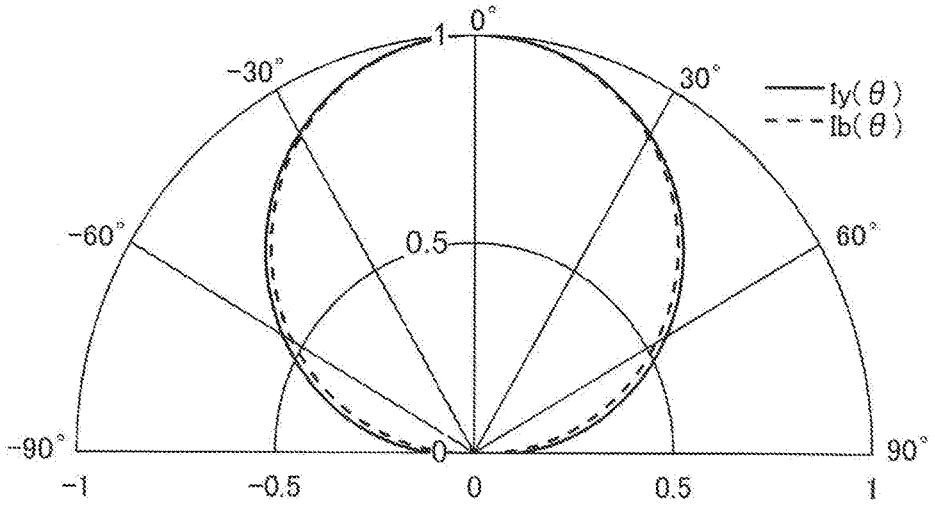
FIG. 11 is a graph showing light distribution characteristics of light emitted from a general light source in polar coordinates.
Figure 12:
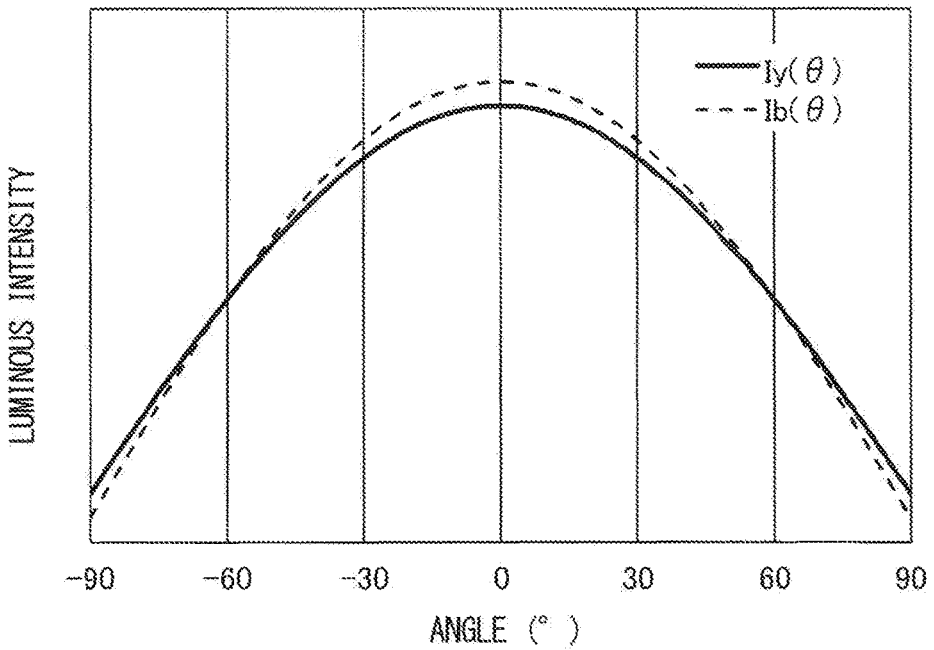
FIG. 12 is a graph showing light distribution characteristics of light emitted from a general light source in orthogonal coordinates.

The cause of the color unevenness of illumination light emitted from the reflector 10 is described below. FIGS. 11 and 12 show light distribution characteristics of the general light source 3 including the light-emitting elements 6 composed of blue LEDs and the sealing resin 7 containing a yellow phosphor. FIG. 11 shows the light distribution characteristics in polar coordinates and the vertical axis and the horizontal axis show luminous intensity normalized on the basis that luminous intensity on the vertical axis is 1. FIG. 12 shows the light distribution characteristics in orthogonal coordinates and the vertical axis show luminous intensity and the horizontal axis represents the angle θ (unit: °) with respect to an optical axis.

In FIGS. 11 and 12, lb(θ) is the emission intensity at 450 nm, which is the emission peak wavelength of the blue LEDs, and ly(θ) is the emission intensity at 560 nm, which is the emission peak wavelength of the yellow phosphor. The emission intensities lb(θ) and ly(θ) are measured by splitting light emitted from the light source 3. The emission intensities lb(θ) and ly(θ) shown in FIG. 12 are normalized such that the individual luminous fluxes determined from integrals with respect to the angle θ coincide with each other.

Referring to FIG. 12, the half width at half maximum (HWHM) of light distribution characteristics of light with a wavelength of 450 nm is about 62°. The half width at half maximum (HWHM) of light distribution characteristics of light with a wavelength of 560 nm is about 64°. Light distribution characteristics measured at the emission peak wavelength (560 nm) of the phosphor are slightly broader as compared to the emission peak wavelength (450 nm) of the blue LEDs.

This is because the influence that light emitted from the phosphor is not directional, whereas light emitted from an LED element is directional with respect to an optical axis, remains when light emerges from the sealing resin 7. Therefore, the directionality of light with a wavelength of 450 nm is slightly narrow, the directionality of light with a wavelength of 560 nm is slightly broad, and the difference therebetween is slight as shown in FIG. 11.

Figure 13:
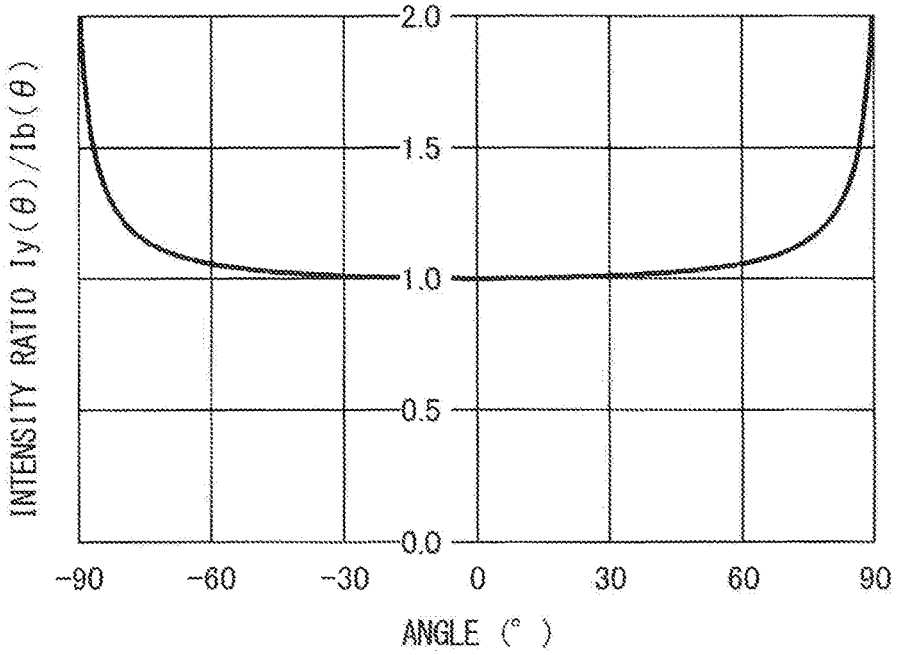
FIG. 13 is a graph showing the intensity ratio between blue light and yellow light emitted from a general light source.

FIG. 13 shows the intensity ratio ly(θ)/lb(θ) between the emission intensities lb(θ) and ly(θ). In this figure, the horizontal axis represents the intensity ratio and the horizontal axis represents the angle θ (unit: °). The intensity ratio is normalized on the basis that the angle θ=0° is 1. According to this figure, the intensity ratio ly(θ)/lb(θ) sharply increases at a high angle where the angle θ is large.

The increase of the intensity ratio ly(θ)/lb(θ) corresponds to the fact that the proportion of a yellow light component increases at a high angle. That is, the color of light emitted from the light source 3 shifts to yellow at a high angle. This is the cause of color unevenness due to the light source 3.

As shown in FIGS. 11 and 12, the emission intensities ly(θ) and lb(θ) sharply decrease at a high angle where the intensity ratio ly(θ)/lb(θ) increases. Therefore, the color unevenness of light emitted from the light source 3 is usually inconspicuous. However, in the case where light emitted from the light source 3 is collected using the reflector 10, color unevenness is conspicuous. This allows a strip-like region (yellow ring) where ring-shaped light with a strong yellow component is collected around an optical axis to be viewed.

Figure 14:
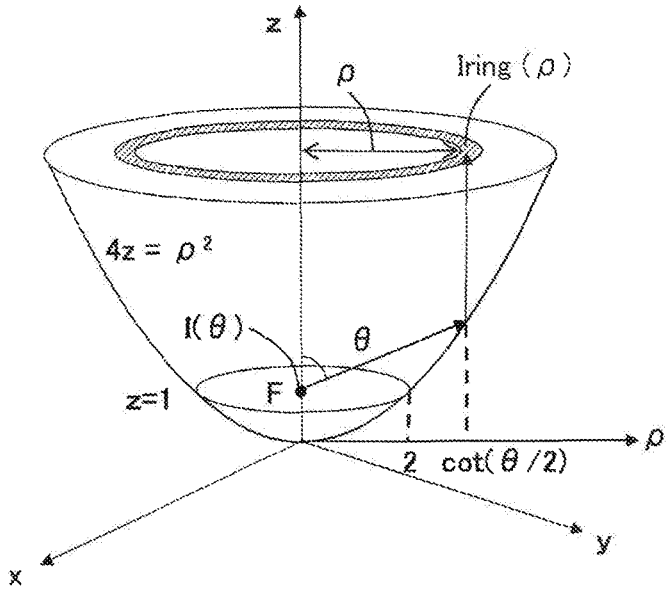
FIG. 14 is a perspective view showing the luminous intensity of light emitted from the reflector.

FIG. 14 shows the luminous intensity of light emitted from the reflector 10 and shows the inner circumferential surface 13*a* of the light-reflecting section 13 of the reflector 10 in perspective view. Herein, a point light source of which the luminous intensity per unit solid angle is I(θ) is placed on the focus F of the paraboloid, which forms the inner circumferential surface 13*a*. The angle θ is one with respect to an axial direction from the focus F of the paraboloid toward the light exit aperture 14 and coincides with an angle with respect to the optical axis of the point light source.

Light emitted from the point light source on the focus F is reflected by the inner circumferential surface 13*a* of the reflector 10 and is thereby converted into parallel rays. In the case where this light is projected on a plane perpendicular to a z-axis, formula (3) is derived, where the luminous intensity per unit area on the radius ρ is Iring(ρ). Formula (4) holds between the radius ρ and the angle θ.

$$Iring(\rho)\cdot 2\pi\rho d\rho = -I(\theta)\cdot 2\pi \sin\theta d\theta \tag{3}$$

$$\rho/2 = \cot(\theta/2) \tag{4}$$

From formulas (3) and (4), Iring(ρ) and I(θ) have a relationship given by formula (5).

$$\begin{aligned} Iring(\rho) &= 1\big/((\rho/2)^2+1)^2\cdot I(\theta) \\ &= \sin^4(\theta/2)\cdot I(\theta) \end{aligned} \tag{5}$$

The luminous intensity Iring-b(ρ) of light with a wavelength of 450 nm and the luminous intensity Iring-y(ρ) of light with a wavelength of 560 nm on a plane perpendicular to the z-axis are derived in such a manner that each of the emission intensities lb(θ) and ly(θ) shown in FIG. 12 is substituted for the luminous intensity I(θ) in formula (5).

Figure 15:
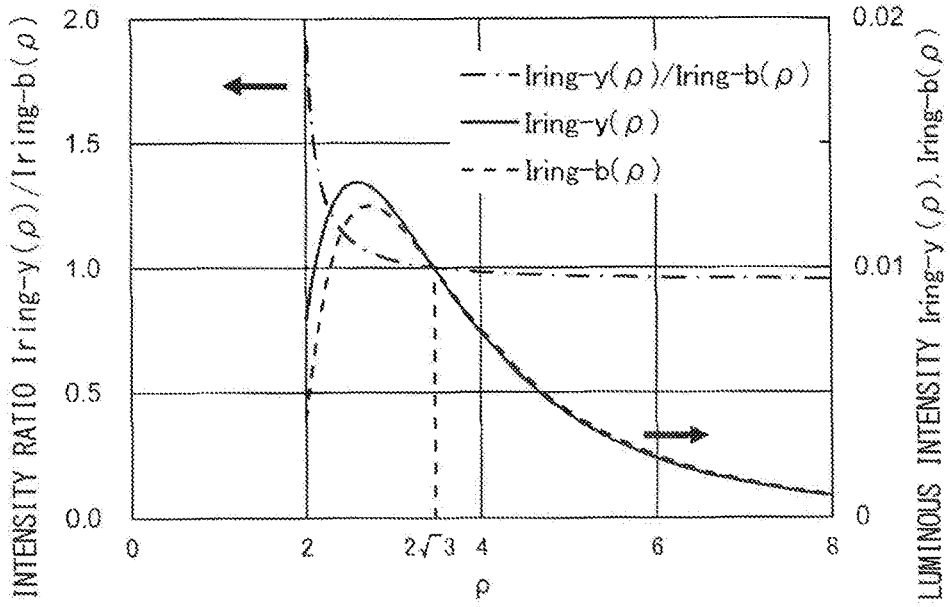
FIG. 15 is a graph showing the intensity of blue light and yellow light emitted from a conventional reflector and the intensity ratio therebetween.

FIG. 15 shows the line profile of each of the luminous intensities Iring-b(ρ) and Iring-y(ρ) and the intensity ratio Iring-y(ρ)/Iring-b(ρ). In this figure, the vertical axis represents the luminous intensity and the intensity ratio and the horizontal axis represents the radius ρ. A position at which a plane which is perpendicular to the z-axis and which passes through the focus F intersects with the inner circumferential surface 13*a* corresponds to a radius ρ of 2. The intensity ratio Iring-y(ρ)/Iring-b(ρ) represents a color shift and sharply increases near the focus F.

The color shift is described below in detail. The half width at half maximum (HWHM) of a light source which has such ideal Lambertian light distribution characteristics that the emission intensity corresponding to FIG. 12 is given by cos θ is 60°. From formula (5), the line profile of the luminous intensity obtained by reflecting light emitted from the light source by the inner circumferential surface 13*a* given by formula (2) peaks at a radius ρ of $2\sqrt{2}$. From formula (4), the angle θ corresponding to this radius ρ is given by cos θ=⅓ (θ≈70.5°).

That is, light emitted from the light source at an angle θ of about 70.5° reflects on the inner circumferential surface 13*a* given by formula (2) to forms an ring-shaped region with the highest luminous intensity at a position given by $\rho=2\sqrt{2}$.

The luminous intensity per unit solid angle of the light source having the ideal Lambertian light distribution characteristics (light distribution: cos θ) is ⅓ at θ≈70.5° with respect to an axial direction (θ=0°). However, as light is emitted to a region where the angle θ is larger, closer to 90° (a direction perpendicular to the z-axis), light is collected at a position closer to a center in a radial direction after being reflected by the inner circumferential surface 13*a*. Therefore, in the luminous intensity per unit area on a plane perpendicular to the z-axis, the line profile of the luminous intensity takes an extremum (herein, a maximum) at θ≈70.5° ($\rho=2\sqrt{2}\approx2.8$), which is not close to θ=0° (ρ=∞) but is close to θ=90° (ρ=2).

Likewise, the line profile of each of the luminous intensities Iring-b(ρ) and Iring-y(ρ) with respect to the light source with the emission intensities lb(θ) and ly(θ) takes a maximum near $\rho=2\sqrt{2}\approx2.8$ (θ≈70.5°).

The half width at half maximum of the emission intensity lb(θ) and that of the emission intensity ly(θ) are slightly wider as compared to the case of Lambertian and are about 62° and about 64°, respectively. Therefore, the radius ρ at which the luminous intensities Iring-b(ρ) and Iring-y(ρ) take a maximum approaches the z-axis, resulting in that ρ≈2.7 (θ≈73°) and ρ≈2.6 (θ≈76°).

The emission intensities lb(θ) and ly(θ) of the light distribution characteristics shown in the orthogonal coordinates in FIG. 12 are normalized such that the integrals (total fluxes) of luminous fluxes obtained therefrom coincide with each other. Therefore, the case where the intensity ratio Iring-y(ρ)/Iring-b(ρ) shown in FIG. 15 is 1 corresponds to a reference value with no variation in chromaticity. The case where the intensity ratio Iring-y(ρ)/Iring-b(ρ) is greater than 1 corresponds to a shift from the reference value to a yellow side. The case where the intensity ratio Iring-y(ρ)/Iring-b(ρ) is less than 1 corresponds to a shift from the reference value to a blue side.

Herein, the intensity ratio Iring-y(ρ)/Iring-b(ρ) is 1 when $\rho=2\sqrt{3}$ (θ=60°). In the range where ρ is $2\sqrt{3}$ to 2 (θ is 60° to 90°), the intensity ratio Iring-y(ρ)/Iring-b(ρ) sharply increases from 1 to 2 and significantly shifts to a yellow side.

The line profile of each of the luminous intensities Iring-b(ρ) and Iring-y(ρ) peaks near substantially an intermediate (ρ=2.6, θ=75°) of a region shifted from the reference value to a yellow side. Therefore, a yellow region represented by the intensity ratio Iring-y(ρ)/Iring-b(ρ) overlaps a light region. As a result, the following ring is viewed: a yellow ring in which light with a strong yellow component is collected in a region where ρ is $2\sqrt{3}$ to 2 (θ is 60° to 90°, z is 3 to 1) around an optical axis.

On the other hand, in a region which is located outside the yellow ring and in which ρ is $2\sqrt{3}$ to ∞ (θ is 60° to 0°), the intensity ratio Iring-y(ρ)/Iring-b(ρ) is less than 1 and slightly shifts to a blue side. The line profiles of the luminous intensities Iring-b(ρ) and Iring-y(ρ) monotonically decrease.

The above shows an ideal case where the point light source is placed on the focus F of the inner circumferential surface 13*a*, which is parabolic, for clear understanding. In practice, the light source 3 has a limited spread and there are the case where the light source 3 is misaligned with the focus F and the case where the shape of the inner circumferential surface 13*a* deviates from a parabola depending on the processing accuracy of the reflector 10. However, these cases are approximated to an ideal state and a yellow ring is caused by a similar factor.

The yellow ring with respect to the light source including the blue LEDS and the yellow phosphor has been described. In another light source, a yellow ring is similarly caused when light distribution characteristics of yellow light have a spread with respect to light distribution characteristics of blue light as shown in FIG. 11.

In another light source, there is the case where light distribution characteristics of blue light have a spread with respect to light distribution characteristics of yellow light. In this case, a blue ring in which blue light is conspicuous is caused by a similar factor and therefore the color unevenness of illumination light is caused.

In this embodiment, the thin-film layer 17 is placed on the inner circumferential surface 13*a* of the light-reflecting section 13 of the reflector 10 as shown in FIGS. 2 and 10. The thin-film layer 17 is formed over the whole part of the inside of the ring-shaped region D, which has an angle θ of 60° to 90° with respect to an axial direction from the focus F of the paraboloid, which forms the inner circumferential surface 13*a*, toward the light exit aperture 14. The axial length of the thin-film layer 17 is 2δ (z is 3 to 1) with the focus F regarded as a lower end.

Therefore, reflected light which is the cause of a yellow ring and in which the angle θ is within the range of 60° to 90° is scattered by the thin-film layer 17. This allows light distribution characteristics of light with different wavelengths to be close to each other suppress the color shift of illumination light to a yellow side and enables the peak of the luminous intensity in this range to be reduced. Thus, the occurrence of the yellow ring can be suppressed.

According to this embodiment, the inner circumferential surface 13*a* of the light-reflecting section 13 made of metal is formed of the paraboloid and the thin-film layer 17, which scatters light, is placed on the inner circumferential surface 13*a*. The thin-film layer 17 is formed over the ring-shaped region D, which has an angle θ of 60° to 90° with respect to a symmetry axis (z-axis) in a direction from the focus F of the paraboloid toward the light exit aperture 14. Herein, the axial length of the ring-shaped region D is 2δ, where δ is the distance from the focus F to the vertex of the paraboloid, which forms the inner circumferential surface 13*a*.

This enables the occurrence of a yellow ring of illumination light emitted from the light exit aperture 14 to be suppressed when the light source 3 is placed near the focus F, thereby enabling the color unevenness of illumination light to be reduced.

The thin-film layer 17 contains ceramic and therefore can be increased in reflectivity, thereby enabling light absorption loss due to the thin-film layer 17 to be suppressed. In addition, since ceramic is excellent in heat resistance and light resistance, the reflector 10, which includes the thin-film layer 17, can be used under severe conditions due to heat and light generated from the light source 3, which has high power.

The non-formation portion 18, in which the thin-film layer 17 is not formed, is placed on the inner circumferential surface 13*a* of the light-reflecting section 13 so as to extend entirely from the ring-shaped region D, in which the thin-film layer 17 is placed, to the light exit aperture 14. This allows the absorption loss of light reflected on the non-formation portion 18 to be reduced, thereby enabling the light-collecting performance of the reflector 10 to be enhanced.

Since ceramic has high electrostatic strength, forming the thin-film layer 17 around the opening 15 enables shorting between the light source 3, which is close to the opening 15, and the reflector 10 to be prevented.

When the thickness of the thin-film layer 17 is 10 μm or more, the color unevenness of illumination light can be reliably reduced.

When the thin-film layer 17 contains a glass binder and ceramic and glass are main components of the thin-film layer 17, the thin-film layer 17 can be formed at low temperature and the base member 11, which has a low melting point, can be used.

Applying the ceramic paint containing the ceramic particles and the glass raw materials to the base member 11 and synthesizing glass by the sol-gel method enable the thin-film layer 17 to be formed at lower temperature. Thus, the damage, such as accuracy deterioration, oxidation, or the like, of the reflector 10 due to heat can be reduced. The base member 11 of the reflector 10 can be formed using the aluminium-based material, which is inexpensive and is easy to process. Thus, costs for the reflector 10 and the lighting device 1 can be reduced.

In the case where the thin-film layer 17 is formed in such a manner that the thermosetting resin containing the ceramic particles is applied to the base member 11, is dried, and is then cured, the damage of the reflector 10 due to heat can be reduced and costs for the reflector 10 and the lighting device 1 can be further reduced.

The protective layer 19, which is made of the insulator for light-transmissive members or high-reflectivity members, is placed so as to cover the inner circumferential surface 13*a* except the thin-film layer 17. Therefore, the reduction in reflectivity or light-collecting performance of the inner circumferential surface 13*a* due to oxidation can be prevented and the electrostatic strength of the reflector 10 can be ensured.

In the case where the anodized film, which is obtained by anodizing the base member 11 made of the aluminium-based material, is used to form the protective layer 19, the protective layer 19 can be formed so as to be hard and excellent in durability. In this case, forming the protective layer 19 after the formation of the thin-film layer 17 enables man-hours needed to manufacture the reflector 10 to be reduced.

Second Embodiment

Figure 16:
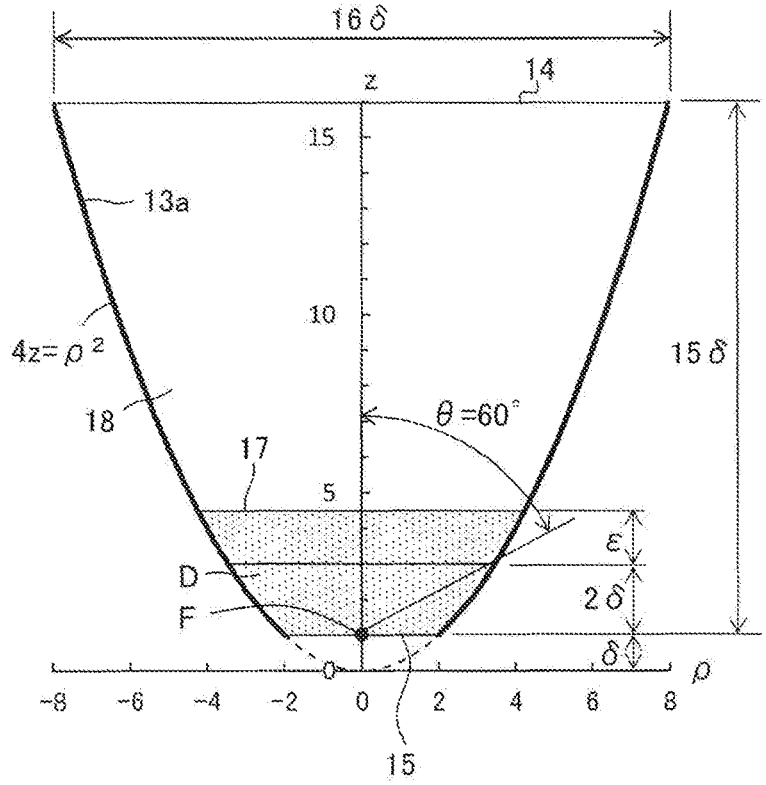
FIG. 16 is a front sectional view illustrating the shape of an inner surface of a reflector of a lighting device according to a second embodiment of the present invention.

FIG. 16 is a front sectional view illustrating the shape of an inner circumferential surface 13*a* of a light-reflecting section 13 of a lighting device 1 according to a second embodiment. For convenience of description, the same portions as those described in the first embodiment with reference to FIGS. 1 to 10 are denoted by the same reference numerals. This embodiment is different in a region for forming a thin-film layer 17 from the first embodiment. Other portions are the same as those described in the first embodiment.

FIG. 16, as well as FIG. 10, shows coordinates of the inner circumferential surface 13*a* on the basis of formula (2). In FIG. 16, the vertex of a paraboloid that forms the inner circumferential surface 13*a* is placed at the origin.

The thin-film layer 17 is formed over the whole part of the inside of a ring-shaped region D with an angle θ of 60° to 90° with respect to an axial direction from the focus F of the paraboloid, which forms the inner circumferential surface 13*a*, toward a light exit aperture 14. The thin-film layer 17 extends from the ring-shaped region D toward the light exit aperture 14 by the distance E.

The whole of the inner circumferential surface 13*a* on the light exit aperture 14 side with respect to the thin-film layer 17 is a non-formation portion 18 in which the thin-film layer 17 is not formed. This allows the non-formation portion 18 to be placed on an end portion of the inner circumferential surface 13*a* that is on the light exit aperture 14 side. A protective layer 19 (see FIG. 2) is placed on the non-formation portion 18. Herein, the area occupancy of the thin-film layer 17 outside the ring-shaped region D is greater than 0% and the area occupancy of the thin-film layer 17 inside the ring-shaped region D is 100% and therefore is greater than that of the thin-film layer 17 outside the ring-shaped region D.

This enables the color unevenness of illumination light emitted from the light exit aperture 14 to be reduced, as is the case with in the first embodiment. Since the thin-film layer 17 extends outside the ring-shaped region D, the diameter of a spot of illumination light emitted from the light exit aperture 14 can be made large, although the light-collecting performance of a reflector 10 is lower than that described in the first embodiment.

Since the area occupancy of the thin-film layer 17 inside the ring-shaped region D is greater than that of the thin-film layer 17 outside the ring-shaped region D, the reduction of light-collecting performance is reduced and the color unevenness of illumination light can be reduced.

The thickness of the thin-film layer 17 outside the ring-shaped region D may be less than that of the thin-film layer 17 inside the ring-shaped region D. This enables light absorption loss due to the thin-film layer 17 outside the ring-shaped region D to be suppressed, thereby enabling the reduction in light-collecting performance of the reflector 10 to be suppressed.

Third Embodiment

Figure 17:
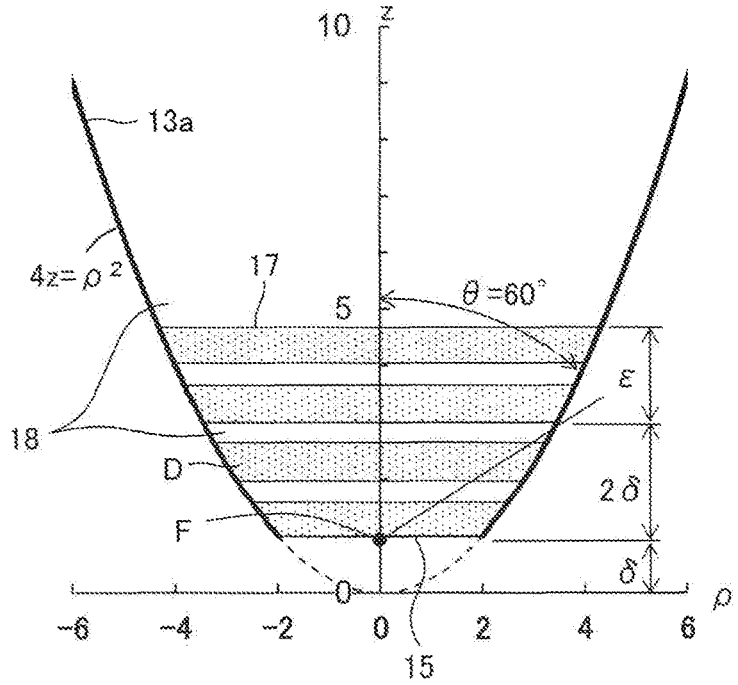
FIG. 17 is a front sectional view illustrating the shape of an inner surface of a reflector of a lighting device according to a third embodiment of the present invention.

FIG. 17 is a front sectional view illustrating the shape of an inner circumferential surface 13*a* of a light-reflecting section 13 of a lighting device 1 according to a third embodiment. For convenience of description, the same portions as those described in the first embodiment with reference to FIGS. 1 to 10 are denoted by the same reference numerals. This embodiment is different in a region for forming a thin-film layer 17 from the first embodiment. Other portions are the same as those described in the first embodiment.

FIG. 17, as well as FIG. 10, shows coordinates of the inner circumferential surface 13*a* on the basis of formula (2). In FIG. 17, the vertex of a paraboloid that forms the inner circumferential surface 13*a* is placed at the origin.

The thin-film layer 17 is formed in a ring-shaped region D with an angle θ of 60° to 90° with respect to an axial direction from the focus F of the paraboloid, which forms the inner circumferential surface 13*a*, toward a light exit aperture 14. The thin-film layer 17 extends from the ring-shaped region D toward the light exit aperture 14 by the distance E. Furthermore, a plurality of thin-film layers 17 are formed in the form of strips arranged in an axial direction.

The whole of the inner circumferential surface 13*a* on the light exit aperture 14 side with respect to the thin-film layers 17 and portions between the thin-film layers 17 are non-formation portions 18 in which the thin-film layer 17 is not formed. A protective layer 19 (see FIG. 2) is placed on each non-formation portion 18. This allows the non-formation portions 18 to be placed on an end portion of the inner circumferential surface 13*a* that is on the light exit aperture 14 side. Herein, the area occupancy of the thin-film layers 17 outside the ring-shaped region D is greater than 0% and the area occupancy of the thin-film layers 17 inside the ring-shaped region D is less than 100% and is greater than that of the thin-film layers 17 outside the ring-shaped region D.

This enables the color unevenness of illumination light to be reduced, as is the case with in the first embodiment. Since the thin-film layer 17 extends outside the ring-shaped region D, the diameter of a spot of illumination light emitted from the light exit aperture 14 can be made large.

Since the area occupancy of the thin-film layers 17 inside the ring-shaped region D is greater than that of the thin-film layers 17 outside the ring-shaped region D, the reduction of light-collecting performance is reduced and the color unevenness of illumination light can be reduced.

The thin-film layers 17 may be formed only inside the ring-shaped region D so as to have a strip shape. The area occupancy of the thin-film layers 17 outside the ring-shaped region D may be 0%. The thickness of the thin-film layers 17 outside the ring-shaped region D may be less than that of the thin-film layers 17 inside the ring-shaped region D.

Fourth Embodiment

Figure 18:
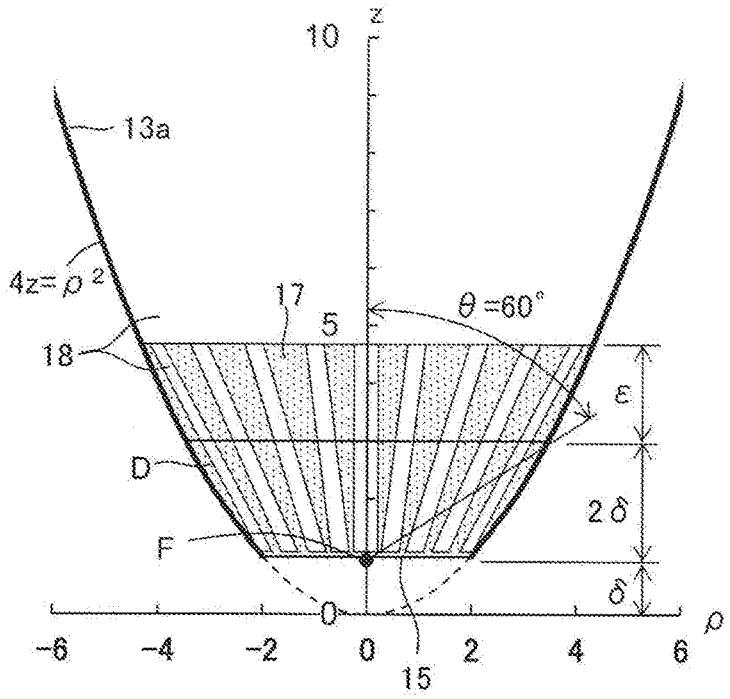
FIG. 18 is a front sectional view illustrating the shape of an inner surface of a reflector of a lighting device according to a fourth embodiment of the present invention.

FIG. 18 is a front sectional view illustrating the shape of an inner circumferential surface 13*a* of a light-reflecting section 13 of a lighting device 1 according to a fourth embodiment. For convenience of description, the same portions as those described in the first embodiment with reference to FIGS. 1 to 10 are denoted by the same reference numerals. This embodiment is different in a region for forming a thin-film layer 17 from the first embodiment. Other portions are the same as those described in the first embodiment.

FIG. 18, as well as FIG. 10, shows coordinates of the inner circumferential surface 13*a* on the basis of formula (2). In FIG. 18, the vertex of a paraboloid that forms the inner circumferential surface 13*a* is placed at the origin.

The thin-film layer 17 is formed in a ring-shaped region D with an angle θ of 60° to 90° with respect to an axial direction from the focus F of the paraboloid, which forms the inner circumferential surface 13*a*, toward a light exit aperture 14. The thin-film layer 17 extends from the ring-shaped region D toward the light exit aperture 14 by the distance ε. Furthermore, a plurality of thin-film layers 17 are formed in the form of strips arranged in a circumferential direction.

The whole of the inner circumferential surface 13*a* on the light exit aperture 14 side with respect to the thin-film layers 17 and portions between the thin-film layers 17 are non-formation portions 18 in which the thin-film layer 17 is not formed. This allows the non-formation portions 18 to be placed on an end portion of the inner circumferential surface 13*a* that is on the light exit aperture 14 side. A protective layer 19 (see FIG. 2) is placed on each non-formation portion 18. Herein, the area occupancy of the thin-film layers 17 outside the ring-shaped region D is greater than 0% and the area occupancy of the thin-film layers 17 inside the ring-shaped region D is less than 100% and is greater than that of the thin-film layers 17 outside the ring-shaped region D.

This enables the color unevenness of illumination light to be reduced, as is the case with in the first embodiment. Since the thin-film layer 17 extends outside the ring-shaped region D, the diameter of a spot of illumination light emitted from the light exit aperture 14 can be made large.

Since the area occupancy of the thin-film layers 17 inside the ring-shaped region D is greater than that of the thin-film layers 17 outside the ring-shaped region D, the reduction of light-collecting performance is reduced and the color unevenness of illumination light can be reduced.

The thin-film layers 17 may be formed only inside the ring-shaped region D so as to have a strip shape. The area occupancy of the thin-film layers 17 outside the ring-shaped region D may be 0%. The thickness of the thin-film layers 17 outside the ring-shaped region D may be less than that of the thin-film layers 17 inside the ring-shaped region D.

Fifth Embodiment

Figure 19:
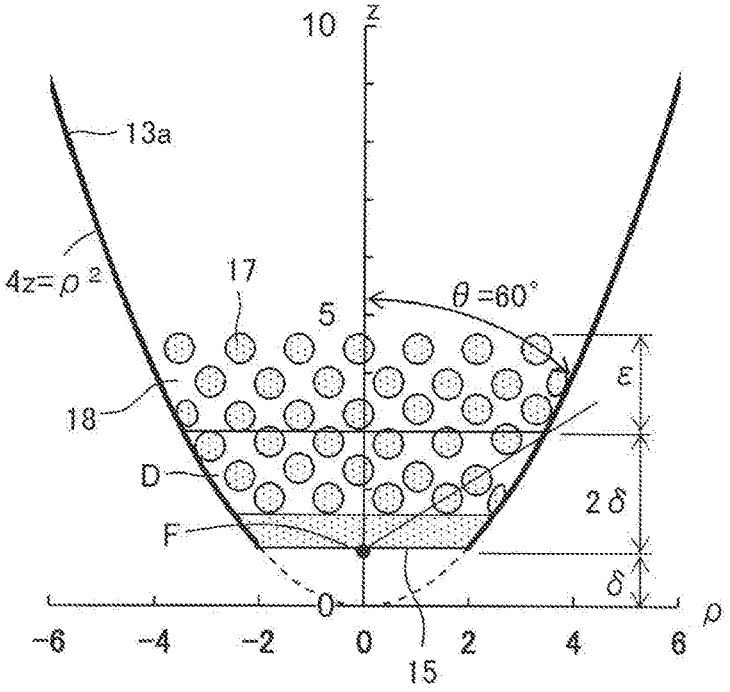
FIG. 19 is a front sectional view illustrating the shape of an inner surface of a reflector of a lighting device according to a fifth embodiment of the present invention.

FIG. 19 is a front sectional view illustrating the shape of an inner circumferential surface 13*a* of a light-reflecting section 13 of a lighting device 1 according to a fifth embodiment. For convenience of description, the same portions as those described in the first embodiment with reference to FIGS. 1 to 10 are denoted by the same reference numerals. This embodiment is different in a region for forming a thin-film layer 17 from the first embodiment. Other portions are the same as those described in the first embodiment.

FIG. 19, as well as FIG. 10, shows coordinates of the inner circumferential surface 13*a* on the basis of formula (2). In FIG. 19, the vertex of a paraboloid that forms the inner circumferential surface 13*a* is placed at the origin.

The thin-film layer 17 is formed in a ring-shaped region D with an angle θ of 60° to 90° with respect to an axial direction from the focus F of the paraboloid, which forms the inner circumferential surface 13*a*, toward a light exit aperture 14. The thin-film layer 17 extends from the ring-shaped region D toward the light exit aperture 14 by the distance ε. Furthermore, a plurality of thin-film layers 17 are formed in the form of dots.

The whole of the inner circumferential surface 13*a* on the light exit aperture 14 side with respect to the thin-film layers 17 and portions between the thin-film layers 17 are non-formation portions 18 in which the thin-film layer 17 is not formed. This allows the non-formation portions 18 to be placed on an end portion of the inner circumferential surface 13*a* that is on the light exit aperture 14 side. A protective layer 19 (see FIG. 2) is placed on each non-formation portion 18. Herein, the area occupancy of the thin-film layers 17 outside the ring-shaped region D is greater than 0% and the area occupancy of the thin-film layers 17 inside the ring-shaped region D is less than 100% and is greater than that of the thin-film layers 17 outside the ring-shaped region D.

This enables the color unevenness of illumination light to be reduced, as is the case with in the first embodiment. Since the thin-film layer 17 extends outside the ring-shaped region D, the diameter of a spot of illumination light emitted from the light exit aperture 14 can be made large.

Since the area occupancy of the thin-film layers 17 inside the ring-shaped region D is greater than that of the thin-film layers 17 outside the ring-shaped region D, the reduction of light-collecting performance is reduced and the color unevenness of illumination light can be reduced.

The thin-film layers 17 may be formed only inside the ring-shaped region D so as to have a dot shape. The area occupancy of the thin-film layers 17 outside the ring-shaped region D may be 0%. The thickness of the thin-film layers 17 outside the ring-shaped region D may be less than that of the thin-film layers 17 inside the ring-shaped region D.

Sixth Embodiment

Figure 20:
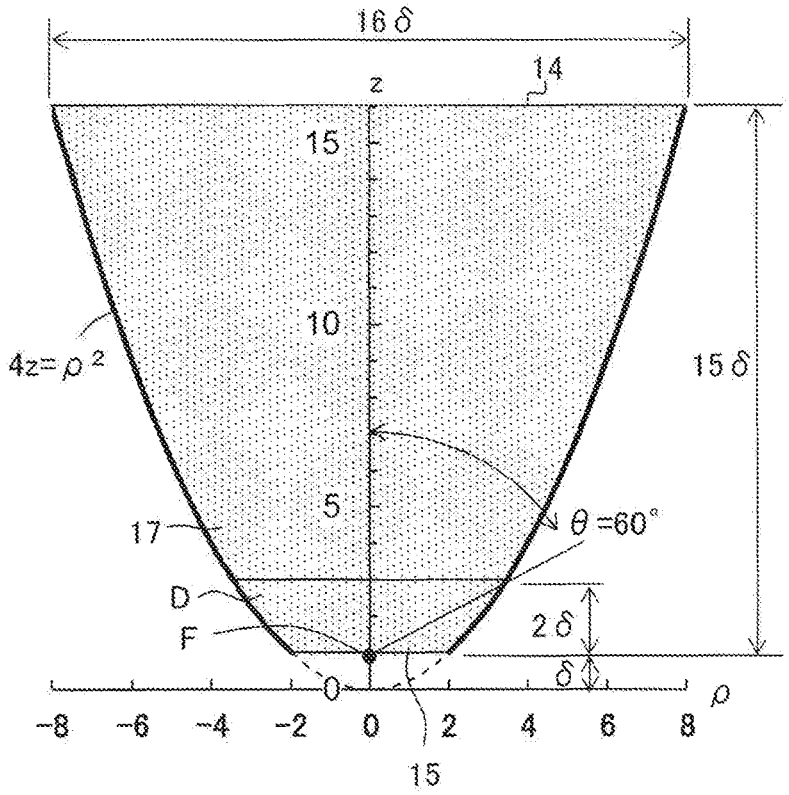
FIG. 20 is a front sectional view illustrating the shape of an inner surface of a reflector of a lighting device according to a sixth embodiment of the present invention.

FIG. 20 is a front sectional view illustrating the shape of an inner circumferential surface 13*a* of a light-reflecting section 13 of a lighting device 1 according to a sixth embodiment. For convenience of description, the same portions as those described in the first embodiment with reference to FIGS. 1 to 10 are denoted by the same reference numerals. This embodiment is different in a region for forming a thin-film layer 17 from the first embodiment. Other portions are the same as those described in the first embodiment.

FIG. 20, as well as FIG. 10, shows coordinates of the inner circumferential surface 13*a* on the basis of formula (2). In FIG. 20, the vertex of a paraboloid that forms the inner circumferential surface 13*a* is placed at the origin.

The thin-film layer 17 is formed over the inner circumferential surface 13*a* including a ring-shaped region D with an angle θ of 60° to 90° with respect to an axial direction from the focus F of the paraboloid, which forms the inner circumferential surface 13*a*, toward a light exit aperture 14. Herein, the area occupancy of the thin-film layer 17 outside the ring-shaped region D is 100% and the area occupancy of the thin-film layer 17 inside the ring-shaped region D is 100%.

This enables the color unevenness of illumination light to be reduced, as is the case with in the first embodiment. The thin-film layer 17 extends outside the ring-shaped region D and therefore the diameter of a spot of illumination light emitted from the light exit aperture 14 can be made large. The thickness of the thin-film layer 17 outside the ring-shaped region D may be less than that of the thin-film layer 17 inside the ring-shaped region D.

In the first to sixth embodiments, the focus F of the paraboloid, which forms the inner circumferential surface 13*a* of the light-reflecting section 13 of the reflector 10, is placed on the opening 15. The focus F of the paraboloid may be placed at a position displaced from the opening 15 in an axial direction. In this case, a similar effect can be obtained in such a manner that the thin-film layer 17 is provided in the ring-shaped region D, which has an angle θ of 60° to 90° with respect to the axial direction from the focus F toward the light exit aperture 14. That is, the color unevenness of illumination light can be reduced in such a manner that the thin-film layer 17 is provided on an end portion on the opposite side (opening 15 side) to the light exit aperture 14.

A non-formation portion 18 of the thin-film layer 17 may be provided in a region opposite to the light exit aperture 14 with respect to the ring-shaped region D. Shorting between the reflector 10 and a light source 3 can be prevented by providing a protective layer 19 around the opening 15.

In the case where heat dissipation of the light source 3 can be ensured, the inner circumferential surface 13*a* may be formed so as to have a portion which is on the opposite side to the light exit aperture 14 and which has a closed shape and the light source 3 may be provided inside the light-reflecting section 13 so as to be close to the focus F.

Seventh Embodiment

Figure 21:
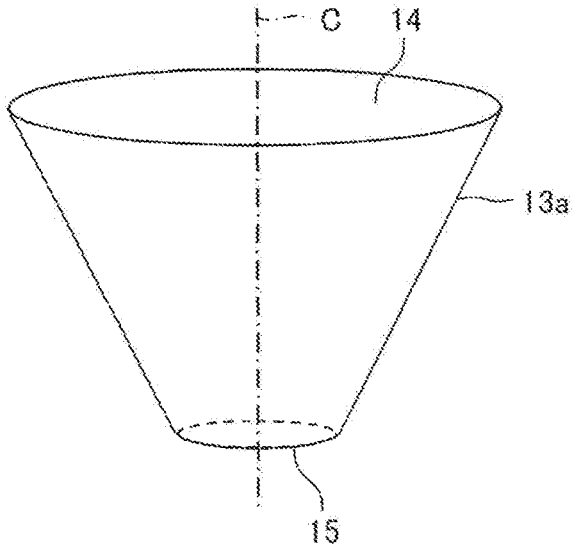
FIG. 21 is a perspective view illustrating the shape of an inner surface of a reflector of a lighting device according to a seventh embodiment of the present invention.
Figure 22:
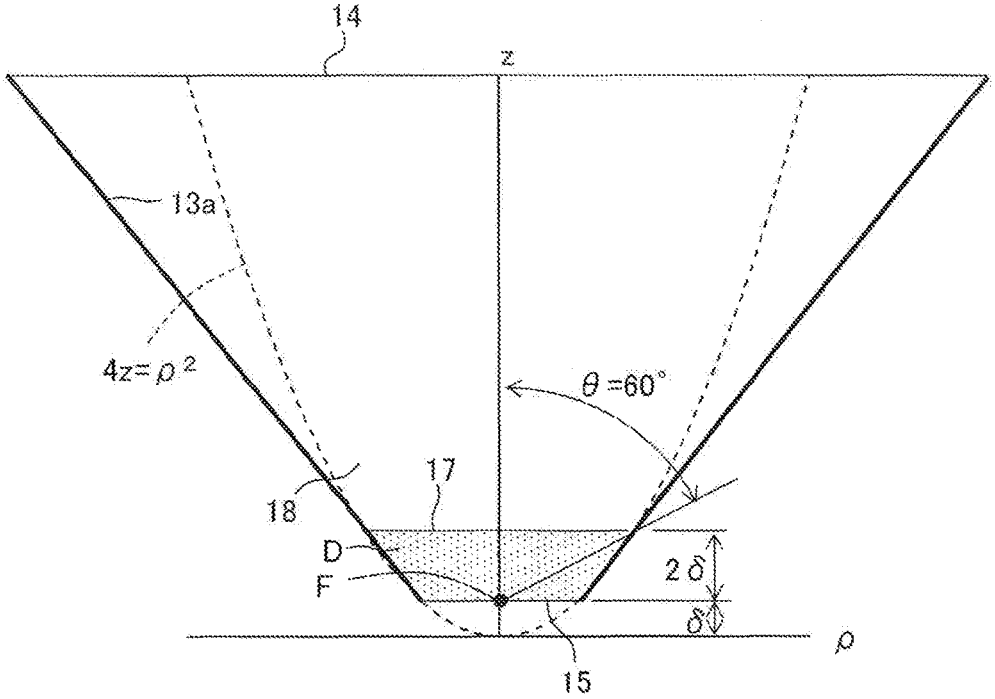
FIG. 22 is a front sectional view illustrating the shape of the inner surface of the reflector of the lighting device according to the seventh embodiment of the present invention.

FIG. 21 and FIG. 22 are a perspective view and front sectional view, respectively, illustrating the shape of an inner circumferential surface 13*a* of a light-reflecting section 13 of a lighting device 1 according to a seventh embodiment. For convenience of description, the same portions as those described in the first embodiment with reference to FIGS. 1 to 10 are denoted by the same reference numerals. This embodiment is different in the shape of the inner circumferential surface 13*a* of the light-reflecting section 13 from the first embodiment. Other portions are the same as those described in the first embodiment.

The light-reflecting section 13 is cylinder-shaped and has a light exit aperture 14 at one end in a direction of a symmetry axis (axis C) and an opening 15 at the other end. The inner circumferential surface 13*a* of the light-reflecting section 13 is a conical surface obtained by rotating a straight line around the axis C. A light source 3 (see FIG. 2) is placed near the center of the opening 15.

A thin-film layer 17 is formed over the inside of a ring-shaped region D with an angle θ of 60° to 90° with respect to an axial direction from the center of the opening 15 toward a light exit aperture 14. Herein, the area occupancy of the thin-film layer 17 outside the ring-shaped region D is 0% and the area occupancy of the thin-film layer 17 inside the ring-shaped region D is 100%.

In an end portion of the light-reflecting section 13 that is on the opening 15 side, the shape of the inner circumferential surface 13*a* can be approximated by a paraboloid (drawn with a broken line in FIG. 22) which has a focus F at the center of the opening 15 and which is given by formula (2). Herein, the distance from the focus F to vertex of the paraboloid, which is approximated to the inner circumferential surface 13*a*, is δ given in formula (1).

Therefore, reflected light which is the cause of a yellow ring and in which the angle θ is within the range of 60° to 90° is scattered by the thin-film layer 17, as is the case with the inner circumferential surface 13*a*, which is parabolic, described in the first embodiment. Thus, the color unevenness of illumination light can be reduced.

In this embodiment, as well as the second to sixth embodiments, the thin-film layer 17 may extend from the ring-shaped region D toward the light exit aperture 14 or non-formation portions 18 may be placed between a plurality of thin-film layers 17.

Eighth Embodiment

Figure 23:
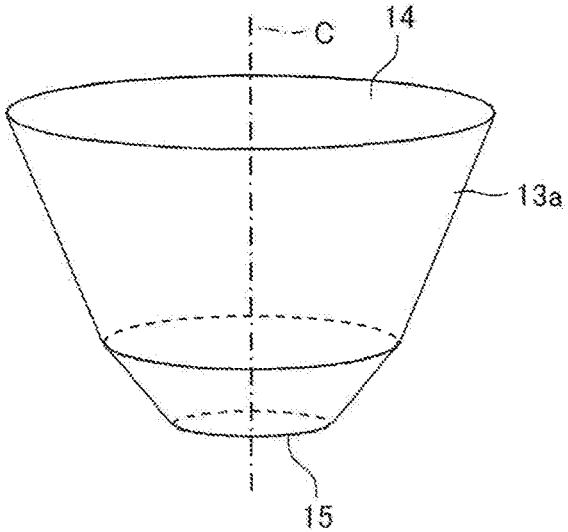
FIG. 23 is a perspective view illustrating the shape of an inner surface of a reflector of a lighting device according to an eighth embodiment of the present invention.
Figure 24:
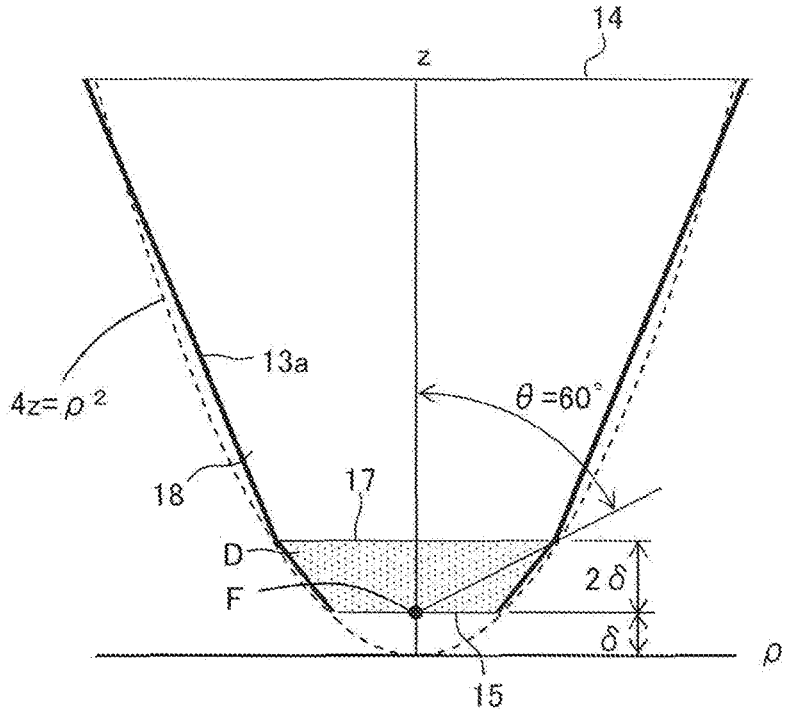
FIG. 24 is a front sectional view illustrating the shape of the inner surface of the reflector of the lighting device according to the eighth embodiment of the present invention.

FIG. 23 and FIG. 24 are a perspective view and front sectional view, respectively, illustrating the shape of an inner circumferential surface 13*a* of a light-reflecting section 13 of a lighting device 1 according to an eighth embodiment. For convenience of description, the same portions as those described in the seventh embodiment with reference to FIGS. 21 and 22 are denoted by the same reference numerals. This embodiment is different in the shape of the inner circumferential surface 13*a* of the light-reflecting section 13 from the seventh embodiment. Other portions are the same as those described in the seventh embodiment.

The light-reflecting section 13 is cylinder-shaped and has a light exit aperture 14 at one end in a direction of a symmetry axis (axis C) and an opening 15 at the other end. The inner circumferential surface 13*a* of the light-reflecting section 13 is formed so as to have a shape made by connecting a plurality of conical surfaces obtained by rotating straight lines around the axis C. A light source 3 (see FIG. 2) is placed near the center of the opening 15.

A thin-film layer 17 is formed over the whole part of the inside of a ring-shaped region D with an angle θ of 60° to 90° with respect to an axial direction from the center of the opening 15 toward a light exit aperture 14.

In an end portion of the light-reflecting section 13 that is on the opening 15 side, the shape of the inner circumferential surface 13*a* can be approximated by a paraboloid (drawn with a broken line in FIG. 24) which has a focus F at the center of the opening 15 and which is given by formula (2). Therefore, reflected light which is the cause of a yellow ring and in which the angle θ is within the range of 60° to 90° is scattered by the thin-film layer 17. Thus, the color unevenness of illumination light can be reduced.

Since the inner circumferential surface 13*a* is formed of a plurality of conical surfaces, the shape of the inner circumferential surface 13*a* can be made closer to a paraboloid than that described in the seventh embodiment and the light-collecting performance thereof can be enhanced.

In this embodiment, as well as the second to sixth embodiments, the thin-film layer 17 may extend from the ring-shaped region D toward the light exit aperture 14 or non-formation portions 18 may be placed between a plurality of thin-film layers 17.

Ninth Embodiment

Figure 25:
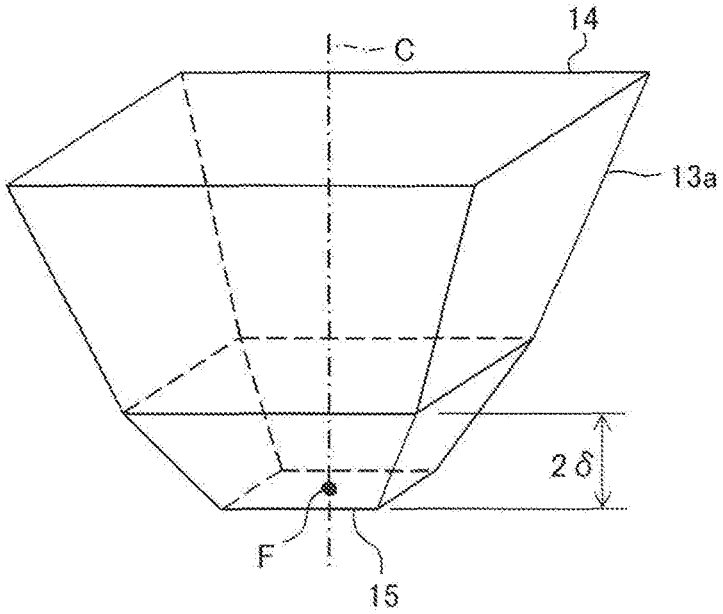
FIG. 25 is a perspective view illustrating the shape of an inner surface of a reflector of a lighting device according to a ninth embodiment of the present invention.

FIG. 25 is a perspective view illustrating the shape of an inner circumferential surface 13*a* of a light-reflecting section 13 of a lighting device 1 according to a ninth embodiment. For convenience of description, the same portions as those described in the eighth embodiment with reference to FIGS. 23 and 24 are denoted by the same reference numerals. This embodiment is different in the shape of the inner circumferential surface 13*a* of the light-reflecting section 13 from the eighth embodiment. Other portions are the same as those described in the eighth embodiment.

The inner circumferential surface 13*a* of the light-reflecting section 13 is formed so as to have a shape made by connecting a plurality of prismoids in an axial direction. The inner circumferential surface 13*a* has a cross-sectional shape which includes a symmetry axis (axis C) and which is identical to that described in the eighth embodiment. This enables an effect similar to that described in the eighth embodiment to be obtained.

Since the inner circumferential surface 13*a* is formed of a plurality of prismoids, the cross-sectional shape of the inner circumferential surface 13*a* can be made closer to a paraboloid than that described in the seventh embodiment and the light-collecting performance thereof can be enhanced.

In this embodiment, as well as the second to sixth embodiments, a thin-film layer 17 may extend from a ring-shaped region D toward a light exit aperture 14 or non-formation portions 18 may be placed between a plurality of thin-film layers 17.

In the seventh to ninth embodiments, the origin of the angle θ representing the range of the ring-shaped region D coincides with the center of the opening 15 of the light-reflecting section 13. The origin of the angle θ representing the range of the ring-shaped region D may coincide with a position displaced from the center of the opening 15 toward the light exit aperture 14 in an axial direction. This enables a similar effect to be obtained by placing a light source 3 near the origin thereof. That is, the color unevenness of illumination light can be reduced in such a manner that the thin-film layer 17 is provided on an end portion on the opposite side (opening 15 side) to the light exit aperture 14.

INDUSTRIAL APPLICABILITY

The present invention can be applied to lighting devices such as high-place lighting in buildings (such as factories, sports facilities, halls, and theaters), large-size lighting for event sites or the like, display lighting for shops or the like, night-time streetlights, spot lights for signboards, lighting-up illuminations for structures or buildings, guide lights for airports or the like, flashlights, and handy spot lights.

REFERENCE SIGNS LIST

1 Lighting device
2 Heat sink
3 Light source
4 Light-emitting module
5 Substrate
6 Light-emitting elements
7 Sealing resin
8 Frame
10 Reflector
11 Base member
12 Outer frame section
13 Light-reflecting section
13*a* Inner circumferential surface
14 Light exit aperture
15 Opening
17 Thin-film layer(s)
18 Non-formation portion(s)
19 Protective layer
C Axis
D Ring-shaped region
F Focus

The invention claimed is:

1. A lighting reflector comprising a base member, made of metal, having an inner circumferential surface expanding toward a light exit aperture open at an end in an axial direction, wherein a thin-film layer which is formed from a thin film containing ceramic and which scatters light is placed on an end portion of the inner circumferential surface that is on the opposite side to the light exit aperture, the inner circumferential surface is formed into a paraboloid, the thin-film layer is formed over the whole part of the inside of a ring-shaped region with an angle of 60° to 90° with respect to an axial direction from the focus of the paraboloid toward the light exit aperture and the area occupancy of the thin-film layer outside the ring-shaped region is less than 100%.

2. The lighting reflector according to claim 1, wherein a buffer layer is placed between the base member and the thin-film layer and the linear expansion coefficient of the buffer layer is less than the linear expansion coefficient of the base member and is greater than the linear expansion coefficient of the thin-film layer.

3. The lighting reflector according to claim 1, wherein the thickness of the thin-film layer outside the ring-shaped region is less than the thickness of the thin-film layer inside the ring-shaped region.

4. The lighting reflector according to claim 1, wherein the thin-film layer mainly contains ceramic and glass.

5. The lighting reflector according to claim 1, wherein a protective layer is placed so as to cover the inner circumferential surface except the thin-film layer, the base member is made of an aluminum-based material, and the protective layer is composed of an anodic oxide coating of the base member.

6. A lighting device comprising the lighting reflector according to claim 1, and a light source placed on an end portion which is on an axis of the lighting reflector and which is on the opposite side to the light exit aperture.

7. The lighting reflector according to claim 2, wherein
the base member is made of aluminum,
the thin-film layer is made of alumina, and
the buffer is made of a NiAl alloy.

8. A lighting reflector comprising a base member, made of metal, having an inner circumferential surface expanding toward a light exit aperture open at an end in an axial direction, wherein a thin-film layer which is formed from a thin film containing ceramic and which scatters light is placed on an end portion of the inner circumferential surface that is on the opposite side to the light exit aperture, the base member is cylinder-shaped and has an opening in an end portion that is on the opposite side to the light exit aperture, the thin-film layer is formed over the whole part of the inside of a ring-shaped region with an angle of 60° to 90° with respect to an axial direction from the center of the opening toward the light exit aperture, and the area occupancy of the thin-film layer outside the ring-shaped region is less than 100%.

9. The lighting reflector according to claim 8, wherein a buffer layer is placed between the base member and the thin-film layer and the linear expansion coefficient of the buffer layer is less than the linear expansion coefficient of the base member and is greater than the linear expansion coefficient of the thin-film layer.

10. The lighting reflector according to claim 8, wherein the thickness of the thin-film layer outside the ring-shaped region is less than the thickness of the thin-film layer inside the ring-shaped region.

11. The lighting reflector according to claim 8, wherein the thin-film layer mainly contains ceramic and glass.

12. The lighting reflector according to claim 8, wherein a protective layer is placed so as to cover the inner circumferential surface except the thin-film layer, the base member is made of an aluminum-based material, and the protective layer is composed of an anodic oxide coating of the base member.

13. A lighting device comprising the lighting reflector according to claim 8 and a light source placed on an end portion which is on an axis of the lighting reflector and which is on the opposite side to the light exit aperture.

14. The lighting reflector according to claim 8, wherein
the base member is made of aluminum,
the thin-film layer is made of alumina, and
the buffer is made of a NiAl alloy.

* * * * *